US007360387B2

(12) United States Patent
Otaki

(10) Patent No.: US 7,360,387 B2
(45) Date of Patent: Apr. 22, 2008

(54) UPSETTING METHOD AND UPSETTING APPARATUS

(75) Inventor: Atsushi Otaki, Oyama (JP)

(73) Assignee: Showa Denko K.K., Tokyo (JP)

( * ) Notice: Subject to any disclaimer, the term of this patent is extended or adjusted under 35 U.S.C. 154(b) by 21 days.

(21) Appl. No.: 11/342,650

(22) Filed: Jan. 31, 2006

(65) Prior Publication Data

US 2006/0254338 A1 Nov. 16, 2006

Related U.S. Application Data

(60) Provisional application No. 60/649,547, filed on Feb. 4, 2005.

(30) Foreign Application Priority Data

Jan. 31, 2005 (JP) ..... 2005-024178

(51) Int. Cl.
*B21D 22/00* (2006.01)

(52) U.S. Cl. ..... 72/353.2; 72/355.6; 72/403

(58) Field of Classification Search ..... 72/358, 72/359, 353.2, 354.2, 354.6, 352, 354.8, 72/355.2, 355.6, 394, 399, 403, 453.02, 377
See application file for complete search history.

(56) References Cited

U.S. PATENT DOCUMENTS

| | | | | |
|---|---|---|---|---|
| 4,317,355 A | | 3/1982 | Hatsuno et al. | |
| 4,838,062 A | * | 6/1989 | Prenn | 72/41 |
| 5,365,765 A | * | 11/1994 | Gohl et al. | 72/355.6 |

FOREIGN PATENT DOCUMENTS

| | | |
|---|---|---|
| DE | 30 09 656 | 9/1980 |
| GB | 2 051 634 A | 1/1981 |
| JP | 48-062646 | 9/1973 |
| JP | 55-126340 | 9/1980 |
| JP | 5-237584 | 9/1993 |
| JP | 09-253782 | 9/1997 |
| JP | 2002-96121 | 4/2002 |
| JP | 2003-53470 | 2/2003 |
| JP | 2003-290862 | 10/2003 |
| JP | 2004-261857 | 9/2004 |

* cited by examiner

*Primary Examiner*—Ed Tolan
*Assistant Examiner*—Debra M Wolfe
(74) *Attorney, Agent, or Firm*—Oblon, Spivak, McClelland, Maier & Neustadt, P.C.

(57) ABSTRACT

To provide an upsetting method capable of efficiently expanding a bar-shaped raw material at least two portions. A plurality of guides 31 and 32 each having an insertion hole 34 are prepared. The bar-shaped raw material 1 secured to a fixed die 20 is inserted and held in each insertion hole 34 of the plurality of guides 31 and 32 in order. Then, a first exposed portion 4 of the raw material 1 exposed between a first guide 31 located at the foremost side of the plurality of guides 31 and 32 and the fixed die 32 is expanded in diameter by moving the plurality of guides 31 and 32 in a direction opposite to a moving direction of the punch 50R in a mutually adhering manner while pressurizing the raw material 1 in the axial direction with the punch 50R. After completion of the movement of the first guide 31, a second exposed portion of the raw material 1 exposed between both the guides 31 and 32 is expanded in diameter by relatively moving the second guide 32 located behind the first guide 31 among the plurality of guides 31 and 32 in a direction opposite to a moving direction of the punch 50R.

20 Claims, 9 Drawing Sheets

UPSETTING METHOD AND UPSETTING APPARATUS

CROSS REFERENCE TO RELATED APPLICATIONS

This application is an application filed under 35 U.S.C. §111(a) claiming the benefit pursuant to 35 U.S.C. §119(e)(1) of the filing date of U.S. Provisional Application No. 60/649,547 filed on Feb. 4, 2005, pursuant to 35 U.S.C. §111(b).

This application claims priority to Japanese Patent Application No. 2005-24178 filed on Jan. 31, 2005, and U.S. Provisional Application No. 60/649,547 filed on Feb. 4, 2005, the entire disclosures of which are incorporated herein by reference in their entireties.

FIELD OF THE INVENTION

The present invention relates to an upsetting method and an upsetting apparatus for radially expanding two or more portions of a bar-shaped raw material.

DESCRIPTION OF THE RELATED ART

In general, upsetting is executed to expand a diameter of a certain portion of a material by pressurizing a bar-shaped raw material in an axial direction thereof. In this upsetting, if a material buckles at the time of the working, the obtained product (upsetting manufactured product) becomes poor in shape (e.g., wrinkles, scratches, etc.), which causes degradation in value as a product. Therefore, in order to prevent the occurrence of such buckling, the following upsetting method is conventionally known.

That is, in this method, a raw material is fixed to a fixed die, and the raw material is inserted into an insertion hole formed in a guide to be held in a buckling prevention state. Subsequently, a guide is moved in a direction opposite to a punch moving direction while pressurizing the raw material in the axial direction with a punch, to thereby radially expand an exposed portion of the raw material exposed between the tip end portion of the guide and the fixed die (see Patent Documents 1 and 2).

[Patent Document 1] Japanese Unexamined Laid-open Patent Publication No. S48-62646

[Patent document 2] Japanese Unexamined Laid-open Patent Publication No. H09-253782

DISCLOSURE OF THE INVENTION

Problems to be Solved by the Invention

In cases where two portions of a raw material are to be expanded in diameter by the aforementioned conventional upsetting method, it can be considered that one portion of the raw material is expanded in diameter, and then the raw material is reversed, thereafter the remaining portion is expanded in diameter. However, this method has a problem that the number of steps required for the work increases since the reversing work of the raw material was required.

The present invention was made in view of the aforementioned technical background, and aims to provide an upsetting method capable of radially expanding at least two portions of a bar-shaped raw material efficiently, and an upsetting apparatus preferably used for the upsetting method.

Means to Solve the Problems

The present invention provides the following means.

[1] An upsetting method, comprising the steps of:

preparing a plurality of guides each having an insertion hole penetrated in an axial direction for holding a bar-shaped raw material in a buckling preventing state;

inserting and holding the raw material secured to a fixed die in each insertion hole of the plurality of guides in order; then expanding a first exposed portion of the raw material exposed between a first guide located at the foremost side of the plurality of guides and the fixed die by moving the plurality of guides in a direction opposite to a moving direction of a punch in a mutually adhering manner while pressurizing the raw material in the axial direction with the punch; and after completion of movement of the first guide, expanding a second exposed portion of the raw material exposed between a second guide and the first guide by relatively moving the second guide located behind the first guide among the plurality of guides in a direction opposite to a moving direction of the punch.

[2] The upsetting method as recited in the aforementioned Item 1, wherein "G" satisfies a relational expression of $$0 \leqq G \leqq P(X_1-X)/(l_0-X_1-Pt_0)$$

when $t_0<T$, in a case in which the first exposed portion of the raw material is expanded in diameter in a non-restricted state, where "P" denotes an average moving speed of the punch from a moving initiation thereof, "G" denotes an average moving speed of the first guide from a moving initiation thereof, "$X_0$" denotes a buckling limit length at a cross-sectional area of the raw material before executing the upsetting, "$X_1$" denotes a buckling limit length at a cross-sectional area of a diameter expanded portion to be formed by diameter expansion of the first exposed portion of the raw material, "X" denotes an initial clearance between the first guide and the fixed die ($0 \leqq X \leqq X_0$), "$t_0$" denotes a time lag from the moving initiation of the punch to the moving initiation of the first guide ($0 \leqq t_0$), "$l_0$" denotes a length of the raw material before executing the upsetting required for the diameter expanded portion, and "T" denotes an upsetting time from the moving initiation of the punch.

[3] The upsetting method as recited in the aforementioned Item 1, wherein "G" satisfies a relational expression of $$G=P(X_g-X)/(L_0-X_p-Pt_0)$$

in a case in which the first exposed portion of the raw material is expanded in diameter in a molding dented portion formed in the fixed die, where "P" denotes an average moving speed of the punch from the moving initiation, "G" denotes an average moving speed of the first guide from the moving initiation, "$X_0$" denotes a buckling limit length at a cross-sectional area of the raw material before executing the upsetting, "X" denotes an initial clearance between a front end potion of the first guide and a bottom portion of the molding dented portion ($0 \leqq X \leqq X_0$), "$L_0$" denotes a length of the raw material before the upsetting required for the diameter expanded portion to be formed by diameter expansion of the first exposed portion, "$X_P$" denotes a stop position of the tip end portion of the punch with respect to the bottom portion of the molding dented portion obtained from a designed volume of the diameter expanded portion, "$X_g$" denotes a stop position of the front end portion of the first guide with respect to the bottom portion of the molding dented portion defined by design, and "$t_0$" denotes a time lag from the moving initiation of the punch to the moving initiation of the first guide ($0 \leqq t_0$).

[4] The upsetting method as recited in any one of the aforementioned Items 1 to 3, wherein at least the first guide among the plurality of guides is capable of being divided into a plurality of pieces by a dividing face vertically crossing the insertion hole.

[5] The upsetting method as recited in any one of the aforementioned Items 1 to 4, wherein the raw material is a round bar-shaped rolled material.

[6] The upsetting method as recited in the aforementioned Item 5, wherein the raw material is a cast rolled material.

[7] The upsetting method as recited in the aforementioned Item 5, wherein the raw material is a continuously cast rolled material.

[8] The upsetting method as recited in any one of the aforementioned Items 5 to 7, wherein the first exposed portion of the raw material and the second exposed portion thereof are expanded in diameter with lubricant adhering to a peripheral surface of each insertion hole of the plurality of guides and/or a surface of the raw material.

[9] The upsetting method as recited in any one of the aforementioned Items 1 to 8, wherein the first exposed portion of the raw material is expand in diameter with a portion of the raw material corresponding to the front end portion of the first guide partially heated.

[10] The upsetting method as recited in the aforementioned Item 9, wherein the portion of the raw material corresponding to the front end portion of the first guide is partially induction-heated by an induction-heating means.

[11] The upsetting method as recited in the aforementioned Item 9, wherein the portion of the raw material corresponding to the front end portion of the first guide is partially heated by partially induction-heating the front end portion of the first guide by an induction-heating means.

[12] The upsetting method as recited in any one of the aforementioned Items 9 to 11, wherein the portion of the raw material corresponding to the front end portion of the first guide is partially heated into a half-molten state.

[13] The upsetting method as recited in any one of the aforementioned Items 9 to 12, wherein the first exposed portion of the raw material is expand in diameter in a state in which a portion of the raw material corresponding to a portion of the first guide located behind the front end portion of the first guide is partially cooled.

[14] The upsetting method as recited in any one of the aforementioned Items 1 to 13, wherein the second exposed portion of the raw material is expand in diameter with a portion of the raw material corresponding to a front end portion of the second guide partially heated.

[15] The upsetting method as recited in the aforementioned Item 14, wherein the portion of the raw material corresponding to the front end portion of the second guide is partially induction-heated by an induction-heating means.

[16] The upsetting method as recited in the aforementioned Item 14, wherein the portion of the raw material corresponding to the front end portion of the second guide is partially heated by partially induction-heating the front end portion of the second guide by an induction-heating means.

[17] The upsetting method as recited in any one of the aforementioned Items 14 to 16, wherein the portion of the raw material corresponding to the front end portion of the second guide is partially heated into a half-molten state.

[18] The upsetting method as recited in any one of the aforementioned Items 14 to 17, wherein the second exposed portion of the raw material is expand in diameter in a state in which a portion of the raw material corresponding to a portion of the second guide located behind the front end portion of the second guide is partially cooled.

[19] An upsetting manufactured product obtained by the upsetting method as recited in any one of the aforementioned Items 1 to 18.

[20] An upsetting method, comprising the steps of:

preparing a plurality of one-side-portion guides each having an insertion hole penetrated in an axial direction for holding one side portion out of axial both side portions of a bar-shaped raw material in a buckling preventing state, the guides being to be arranged in the axial direction, at least one the-other-side-portion guide having an insertion hole penetrated in an axial direction for holding the other side portion of the raw material in a buckling preventing state, a one-side-portion punch for pressurizing one side portion of the raw material in an axial direction, and a the-other-side-portion punch for pressurizing the other side portion of the raw material in an axial direction;

inserting and holding the one side portion of the raw material with the axial intermediate portion secured to a fixed die in each insertion hole of the plurality of one-side-portion guides in order, and inserting and holding the other side portion of the raw material in the insertion hole of the-other-side-portion guide;

subsequently expanding a first exposed portion of the raw material exposed between the first guide placed at the foremost side among the plurality of one-side-portion guides and the fixed die by integrally moving the plurality of one-sides-portion guides in a direction opposite to the moving direction of the one-side-portion punch in a mutually adhering manner while pressurizing one side portion of the raw material in an axial direction with the one-side-portion punch;

after termination of movement of the first guide, expanding a second exposed portion of the raw material exposed between the second guide and the first guide by mutually moving the second guide placed behind the first guide among the plurality of one-sides-portion guides in a direction opposite to a moving direction of the one-side-portion punch;

expanding a third exposed portion of the raw material exposed between the-other-side-portion guide and the fixed die by moving the-other-side-portion guide in a direction opposite to the moving direction of the-other-side-portion punch while pressurizing the other side portion of the raw material in an axial direction with the-other-side-portion punch simultaneously with pressurizing of the one side portion of the raw material with the one-side-portion punch.

[21] The upsetting method as recited in the aforementioned Item 20, wherein "G" satisfies a relational expression of $$0 \leqq G \leqq P(X_1 - X)/(l_0 - X_1 - Pt_0)$$

when $t_0 < T$, in a case in which the first exposed portion of the raw material is expanded in diameter in a non-restricted state, where "P" denotes an average moving speed of the one-side-portion punch from a moving initiation thereof, "G" denotes an average moving speed of the first guide from a moving initiation thereof, "$X_0$" denotes a buckling limit length at a cross-sectional area of the raw material before executing the upsetting, "$X_1$" denotes a buckling limit length at a cross-sectional area of a diameter expanded portion to be formed by diameter expansion of the first exposed portion of the raw material, "X" denotes an initial clearance between the first guide and the fixed die ($0 \leqq X \leqq X_0$), "$t_0$" denotes a time lag from the moving initiation of the one-side-portion punch to the moving initiation of the first guide ($0 \leqq t_0$), "$l_0$" denotes a length of the raw material before executing the upsetting required for the diameter expanded portion, and "T" denotes an upsetting time from the moving initiation of the one-side-portion punch.

[22] The upsetting method as recited in the aforementioned Item 20, wherein "G" satisfies a relational expression of $$G=P(X_g-X)/(L_0-X_p-Pt_0)$$

in a case in which the first exposed portion of the raw material is expanded in diameter in a molding dented portion formed in the fixed die, where "P" denotes an average moving speed of the one-side-portion punch from the moving initiation thereof, "G" denotes an average moving speed of the first guide from the moving initiation thereof, "$X_0$" denotes a buckling limit length at a cross-sectional area of the raw material before executing the upsetting, "X" denotes an initial clearance between a front end potion of the first guide and the bottom portion of the molding dented portion ($0 \leqq X \leqq X_0$), "$L_0$" denotes a length of the raw material before executing the upsetting required for the diameter expanded portion to be formed by diameter expansion of the first exposed portion, "$X_P$" denotes a stop position of the tip end portion of the one-side-portion punch with respect to the bottom portion of the molding dented portion obtained from a designed volume of the diameter expanded portion, "$X_g$" denotes a stop position of the front end portion of the first guide with respect to the bottom portion of the molding dented portion defined by design, and "$t_0$" denotes a time lag from a moving initiation of the one-side-portion punch to the moving initiation of the first guide ($0 \leqq t_0$).

[23] The upsetting method as recited in any one of the aforementioned Items 20 to 22, wherein at least the first guide among the plurality of the one-side-portion guides is capable of being divided into a plurality of pieces by a dividing face vertically crossing the insertion hole.

[24] The upsetting method as recited in any one of the aforementioned Items 20 to 23, wherein the raw material is a round bar-shaped rolled material.

[25] The upsetting method as recited in the aforementioned Item 24, wherein the raw material is a cast rolled material.

[26] The upsetting method as recited in the aforementioned Item 24, wherein the raw material is a continuously cast rolled material.

[27] The upsetting method as recited in any one of the aforementioned Items 24 to 26, wherein the first exposed portion of the raw material, the second exposed portion thereof and the third exposed portion thereof are expanded in diameter with lubricant adhering to at least one of a peripheral surface of each insertion hole of the plurality of the one-side-portion guides, a peripheral surface of the insertion hole of the other-side-portion guide and a surface of the raw material.

[28] The upsetting method as recited in any one of the aforementioned Items 20 to 27, wherein the first exposed portion of the raw material is expand in diameter with a portion of the raw material corresponding to a front end portion of the first guide partially heated.

[29] The upsetting method as recited in the aforementioned Item 28, wherein the portion of the raw material corresponding to the front end portion of the first guide is partially induction-heated by an induction-heating means.

[30] The upsetting method as recited in the aforementioned Item 28, wherein the portion of the raw material corresponding to the front end portion of the first guide is partially heated by partially induction-heating the front end portion of the first guide by an induction-heating means.

[31] The upsetting method as recited in any one of the aforementioned Items 28 to 30, wherein the portion of the raw material corresponding to the front end portion of the first guide is partially heated into a half-molten state.

[32] The upsetting method as recited in any one of the aforementioned Items 28 to 31, wherein the first exposed portion of the raw material is expand in diameter in a state in which a portion of the raw material corresponding to a portion of the first guide located behind the front end portion of the first guide is partially cooled.

[33] The upsetting method as recited in any one of the aforementioned Items 20 to 32, wherein the second exposed portion of the raw material is expand in diameter with a portion of the raw material corresponding to a front end portion of the second guide partially heated.

[34] The upsetting method as recited in the aforementioned Item 33, wherein the portion of the raw material corresponding to the front end portion of the second guide is partially induction-heated by an induction-heating means.

[35] The upsetting method as recited in the aforementioned Item 33, wherein the portion of the raw material corresponding to the front end portion of the second guide is partially heated by partially induction-heating the front end portion of the second guide by an induction-heating means.

[36] The upsetting method as recited in any one of the aforementioned Items 33 to 35, wherein the portion of the raw material corresponding to the front end portion of the second guide is partially heated into a half-molten state.

[37] The upsetting method as recited in any one of the aforementioned Items 33 to 36, wherein the second exposed portion of the raw material is expand in diameter in a state in which a portion of the raw material corresponding to a portion of the second guide located behind the front end portion of the second guide is partially cooled.

[38] The upsetting method as recited in any one of the aforementioned Items 20 to 37, wherein the third exposed portion of the raw material is expand in diameter with a portion of the raw material corresponding to a front end portion of the third guide partially heated.

[39] The upsetting method as recited in the aforementioned Item 38, wherein the portion of the raw material corresponding to the front end portion of the third guide is partially induction-heated by an induction-heating means.

[40] The upsetting method as recited in the aforementioned Item 38, wherein the portion of the raw material corresponding to the front end portion of the third guide is partially heated by partially induction-heating the front end portion of the third guide by an induction-heating means.

[41] The upsetting method as recited in any one of the aforementioned Items 38 to 40, wherein the portion of the raw material corresponding to the front end portion of the third guide is partially heated into a half-molten state.

[42] The upsetting method as recited in any one of the aforementioned Items 38 to 41, wherein the third exposed portion of the raw material is expand in diameter in a state in which a portion of the raw material corresponding to a portion of the third guide located behind the front end portion of the third guide is partially cooled.

[43] An upsetting manufactured product obtained by the upsetting method as recited in any one of the aforementioned Items 20 to 42.

[44] An upsetting apparatus, comprising:

a plurality of guides each having an insertion hole penetrated in an axial direction for holding a bar-shaped raw material in a buckling preventing state, the guides being arranged in an axial direction;

a punch for pressurizing the raw material in an axial direction; and a plurality of guide driving apparatuses for moving each guide of the plurality of guides in a direction opposite to a moving direction of the punch.

[45] The upsetting apparatus as recited in the aforementioned Item 44, wherein at least the guide located at the foremost side of the plurality of guides is capable of being divided into a plurality of pieces by a dividing face vertically crossing the insertion hole.

[46] The upsetting apparatus as recited in the aforementioned Item 44 or 45, wherein the raw material is a round bar-shaped rolled material, and wherein the upsetting apparatus further comprises lubricant applying means for making lubricant adhere to a peripheral surface of each insertion hole of the plurality of guides and/or a surface of the raw material.

[47] The upsetting apparatus as recited in the aforementioned Item 46, wherein the raw material is a cast rolled material.

[48] The upsetting apparatus as recited in the aforementioned Item 46, wherein the raw material is a continuously cast rolled material.

[49] The upsetting apparatus as recited in any one of the aforementioned Items 44 to 48, further comprising a heating means for partially heating a portion of the raw material corresponding to the front end portion of at least one guide among the plurality of guides.

[50] The upsetting apparatus as recited in the aforementioned Item 49, wherein the heating means is an induction-heating means having an induction-heating coil configured to partially induction-heat the portion of the raw material corresponding to the front end portion of the at least one guide with the induction-heating means.

[51] The upsetting apparatus as recited in the aforementioned Item 49, wherein the heating means is an induction-heating means having an induction-heating coil configured to partially heat the portion of the raw material corresponding to the front end portion of the at least one guide by partially induction-heating the front end portion of the at least one guide with the induction-heating means.

[52] The upsetting apparatus as recited in any one of the aforementioned Items 49 to 51, wherein the heating means is capable of partially heating the portion of he raw material corresponding to the front end portion of the at least one guide into a half-molten state.

[53] The upsetting apparatus as recited in any one of the aforementioned Items 49 to 52, further comprising a cooling means for partially cooling a portion of the raw material corresponding to a portion of the at least one guide located behind the front end portion of the at least one guide.

[54] An upsetting apparatus, comprising:

a plurality of one-side-portion guides each having an insertion hole penetrated in an axial direction for holding one side portion of axial both side portions of a bar-shaped raw material in a buckling preventing state, the guides being arranged in the axial direction;

at least one the-other-side-portion guide having an insertion hole penetrated in an axial direction for holding the other side portion of the raw material in a buckling preventing state;

a one-side-portion punch for pressurizing one side portion of the raw material in an axial direction;

a the-other-side-portion punch for pressurizing the other side portion of the raw material in an axial direction;

a plurality of one-side-portion guide driving apparatuses for moving each guide of the plurality of one-side-portion guides in a direction opposite to the moving direction of the one-side-portion punch; and a the-other-side-portion guide driving apparatus for moving the-other-side-portion guide in a direction opposite to a moving direction of the-other-side-portion punch.

[55] The upsetting apparatus as recited in the aforementioned Item 54, wherein at least the first guide located at the foremost side of the plurality of the one-side portion guides is capable of being divided into a plurality of pieces by a dividing face vertically crossing the insertion hole.

[56] The upsetting apparatus as recited in the aforementioned Item 54 or 55, wherein the raw material is a round bar-shaped rolled material, and wherein the upsetting apparatus further comprises lubricant applying means for making lubricant adhere to at least one of a peripheral surface of each insertion hole of the plurality of the one-side-portion guides, a peripheral surface of the insertion hole of the-other-side guide and a surface of the raw material.

[57] The upsetting apparatus as recited in the aforementioned Item 56, wherein the raw material is a rolled material.

[58] The upsetting apparatus as recited in the aforementioned Item 56, wherein the raw material is a continuously rolled material.

[59] The upsetting apparatus as recited in any one of the aforementioned Items 54 to 58, further comprising a heating means for partially heating a portion of the raw material corresponding to the front end portion of at least one guide among the plurality of the one-side-portion guides and the-other-side-portion guide.

[60] The upsetting apparatus as recited in the aforementioned Item 59, wherein the heating means is an induction-heating means having an induction-heating coil configured to partially induction-heat the portion of the raw material corresponding to the front end portion of the at least one guide with an induction-heating means.

[61] The upsetting apparatus as recited in the aforementioned Item 59, wherein the heating means is an induction-heating means having an induction-heating coil configured to partially heat the portion of the raw material corresponding to the front end portion of the at least one guide by partially induction-heating the front end portion of the at least one guide with the induction-heating means.

[62] The upsetting apparatus as recited in any one of the aforementioned Items 59 to 61, wherein the heating means is capable of partially heating the portion of the raw material corresponding to the front end portion of the at least one guide into a half-molten state.

[63] The upsetting apparatus as recited in any one of the aforementioned Items 59 to 62, further comprising a cooling means for partially cooling a portion of the raw material corresponding to a portion of the at least one guide located behind the front end portion of the at least one guide.

Effects of the Invention

The present invention has the following effects.

According to the invention as recited in the aforementioned Item [1], at least two portions (the first exposed portion and the second exposed portion) of the raw material can be expanded in diameter without requiring the reversing of the raw material. Therefore, in expanding two or more portions of the raw material by the upsetting, the diameter expansion working can be performed efficiently.

According to the invention as recited in the aforementioned Item [2], since the exposed portion of the raw material is expanded in diameter in a non-restrained manner, the exposed portion can be expanded in diameter by a low punch pressing force, i.e., a low molding pressure, which in turn can reduce the driving force for driving the punch. Furthermore, since the exposed portion can be expanded in diameter without using an expensive forming die having a molding dented portion, the manufacturing cost, i.e., working cost, can be reduced. Furthermore, when the average moving speed G from the moving initiation of the guide satisfies the prescribed relational expression, the buckling which may sometimes cause at the time of working can be prevented assuredly.

According to the invention as recited in the aforementioned Item [3], the exposed portion of the raw material can be assuredly expanded in diameter into a designed shape.

According to the invention as recited in the aforementioned Item [4], the removal of the upsetting manufactured product from the guide insertion hole can be performed without problem after the completion of the working.

According to the invention as recited in the aforementioned Item [5], since the round bar-shaped raw material made of a rolled material can be obtained or manufactured at low cost, the working cost can be reduced by using this raw material as a raw material for the upsetting.

Furthermore, this material is poor in circularity as compared with a round bar-shaped raw material made of an extruded material. Therefore, when this raw material is inserted into the insertion hole of the guide, a gap will be inevitably generated between the surface of the raw material and the peripheral surface of the insertion hole. Thus, the contact-surface area therebetween is small. Therefore, since the frictional-resistance force at the time of slidably moving the raw material in the insertion hole of the guide in the axial direction is small, the molding pressure can be reduced. Therefore, as a punch driving apparatus for moving the punch, a small one can be used, enabling space-saving of an installation space for the upsetting apparatus.

Furthermore, since the molding pressure can be reduced, there are following advantages. That is, if the molding pressure is large, the end portion of the raw material can be sometimes crushed within the insertion hole of the guide by the pressing force from the punch. In this case, some material of the raw material is introduced into the gap between the peripheral surface of the punch and the peripheral surface of the insertion hole, causing an increased molding pressure, which in turn causes a problem that it becomes impossible for the punch to move in the insertion hole in the pressing direction with unworkable. When the molding pressure is reduced, such problem does not occur, resulting in an efficient diameter expansion work of the raw material over a long region.

According to the invention as recited in the aforementioned Item [6], since the round bar-shaped raw material made of a cast rolled material can be obtained or manufactured at low cost, the working cost can be further reduced by using this raw material as a raw material for the upsetting.

According to the invention as recited in the aforementioned Item [7], since the round bar-shaped raw material made of a continuously cast rolled material can be obtained or manufactured at low cost, the working cost can be still further reduced by using this raw material as a raw material for the upsetting.

According to the invention as recited in the aforementioned Item [8], there are the following advantages. That is, as mentioned above, since the round bar-shaped raw material made of a rolled material is low in circularity, when this raw material is inserted into the insertion hole of the guide, a gap will be generated inevitably between the surface of the raw material and the peripheral surface of the insertion hole. In cases where the lubricant is adhering to the peripheral surface of each insertion hole of the plurality of guides and/or the surface of the raw material, the lubricant is introduced into this gap and retained temporarily. Thereby, the application of the lubricant to the peripheral surface of the insertion hole and the surface of the raw material is enhanced. That is, in accordance with the axial slide movement of the raw material in the insertion hole at the time of working, the lubricant in the gap is applied to the peripheral surface of the insertion hole and the surface of the raw material. Thereby, the frictional-resistance force between the peripheral surface of the insertion hole and the surface of the raw material can be reduced assuredly, namely, the molding pressure can be reduced assuredly.

According to the invention as recited in the aforementioned Item [9], since only the deformation resistance of the portion of the raw material corresponding to the front end portion of the first guide is partially reduced, the molding pressure can be reduced. On the other hand, since the portion of the raw material corresponding to the portion of the first guide located behind the front end portion of the first guide, the deformation resistance will not be reduced. Therefore, it is possible to prevent the increasing of the molding pressure to be caused by the expansion of the raw material within the insertion hole of the first guide due to the pressing force by the punch.

According to the invention as recited in the aforementioned Item [10], the portion of the raw material corresponding to the front end portion of the first guide can be heated assuredly and very efficiently.

According to the invention as recited in the aforementioned Item [11], the portion of the raw material corresponding to the front end portion of the first guide can be heated assuredly and very efficiently.

According to the invention as recited in the aforementioned Item [12], the molding pressure can be reduced significantly.

According to the invention as recited in the aforementioned Item [13], the heating of the portion of the raw material corresponding to the portion of the first guide located behind the front end portion of the first guide can be prevented assuredly. Therefore, deterioration of the deformation resistance of this portion of the raw material can be restrained assuredly.

According to the invention as recited in the aforementioned Item [14], since deformation resistance is partially reduced only at the portion of the raw material corresponding to the front end portion of the second guide, the molding pressure can be reduced. On the other hand, since the portion of the raw material corresponding to the portion of the second guide located behind the front end portion of the second guide is not heated, the deformation resistance would not be reduced. Therefore, it is possible to prevent the increasing of the molding pressure to be caused by the expansion of the raw material within the insertion hole of the second guide due to the pressing force by the punch.

According to the invention as recited in the aforementioned Item [15], the portion of the raw material corresponding to the front end portion of the second guide can be heated assuredly and very efficiently.

According to the invention as recited in the aforementioned Item [16], the portion of the raw material corresponding to the front end portion of the second guide can be heated assuredly and very efficiently.

According to the invention as recited in the aforementioned Item [17], the molding pressure can be reduced significantly.

According to the invention as recited in the aforementioned Item [18], the heating of the portion of the raw material corresponding to the portion of the second guide located behind the front end portion of the second guide can be prevented assuredly. Therefore, deterioration of the deformation resistance of this portion of the raw material can be restrained assuredly.

According to the invention as recited in the aforementioned Item [19], a high quality upsetting manufactured product in which two or more diameter expanded portions are formed can be provided.

According to the invention as recited in the aforementioned Item [20], at least three portions (the first exposed portion, the second exposed portion and the third exposed portion) of the raw material can be expanded in diameter without requiring the reversing of the raw material. Therefore, in expanding three or more portions of the raw material by the upsetting, the diameter expansion working can be performed efficiently.

According to the invention as recited in the aforementioned Item [21] to [37], the same effects as in the invention as recited in the aforementioned Items [2] to [18] can be attained.

According to the invention as recited in the aforementioned Item [38], since only the deformation resistance of the portion of the raw material corresponding to the front end portion of the third guide is partially reduced, the molding pressure can be reduced. On the other hand, since the portion of the raw material corresponding to the portion of the third guide located behind the front end portion of the third guide, the deformation resistance will not be reduced. Therefore, it is possible to prevent the increasing of the molding pressure to be caused by the expansion of the raw material within the insertion hole of the other side portion guide due to the pressing force by the punch.

According to the invention as recited in the aforementioned Item [39], the portion of the raw material corresponding to the front end portion of the third guide can be heated assuredly and very efficiently.

According to the invention as recited in the aforementioned Item [40], the portion of the raw material corresponding to the front end portion of the third guide can be heated assuredly and very efficiently.

According to the invention as recited in the aforementioned Item [41], the molding pressure can be reduced significantly.

According to the invention as recited in the aforementioned Item [42], the heating of the portion of the raw material corresponding to the portion of the third guide located behind the front end portion of the third guide can be prevented assuredly. Therefore, deterioration of the deformation resistance of the portion of the raw material can be restrained assuredly.

According to the invention as recited in the aforementioned Item [43], a high quality upsetting manufactured product in which three or more diameter expanded portions are formed can be provided.

According to the invention as recited in the aforementioned Item [44] to [53], an upsetting apparatus preferably used for the unsetting method of the invention as recited in any one of the aforementioned Items [1] to [18] can be provided.

According to the invention as recited in the aforementioned Item [54] to [63], an upsetting apparatus preferably used for the unsetting method of the invention as recited in any one of the aforementioned Items [20] to [42] can be provided.

DETAILED DESCRIPTION OF THE PREFERRED EMBODIMENTS

Next, some embodiments of the present invention will be explained below with reference to drawings.

FIGS. 1 to 5 are schematic views for explaining an upsetting method using an upsetting apparatus according to a first embodiment of the present invention.

Figure 1:
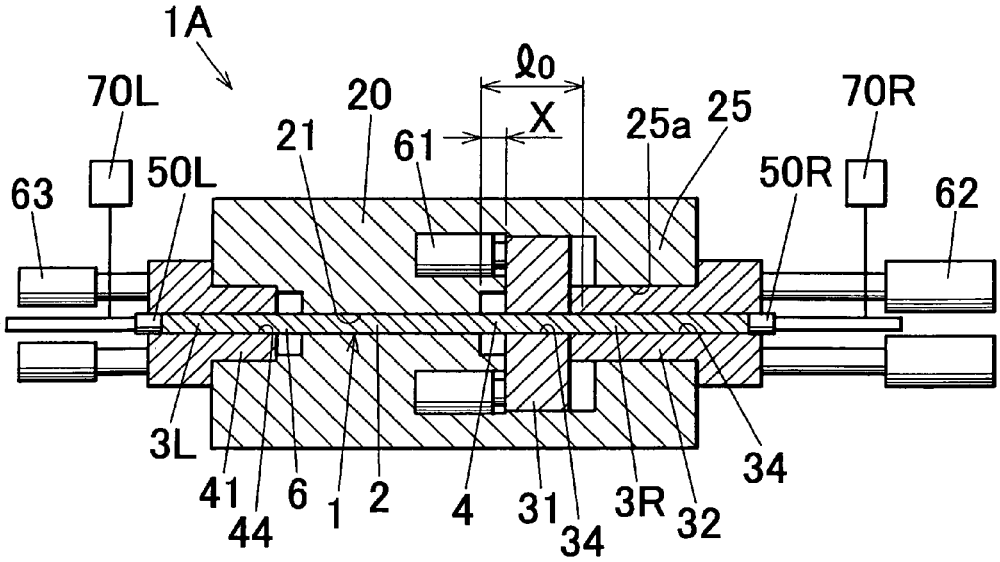
FIG. 1 is a vertical cross-sectional view of a principal part of an upsetting apparatus showing the state before radially expanding prescribed portions of a raw material with the upsetting apparatus according to a first embodiment of the present invention.

In FIG. 1, "1A" denotes an upsetting apparatus according to a first embodiment, and "1" denotes a raw material. Moreover, in FIG. 5, "10A" denotes an upsetting manufactured product manufactured by the upsetting apparatus 1A. This upsetting manufactured product 10A has three approximately spherical diameter enlarged portions 7, 8 and 9 formed on the bar-shaped shank.

As shown in FIG. 1, the raw material 1 is a straight bar-shaped member made of, e.g., aluminum (including its alloy, hereinafter simply referred to as "aluminum). The raw material 1 is round in cross-section and constant in cross-sectional area along the axial direction.

In the present invention, the material of the raw material 1 is not limited to aluminum, and can be metal, such as, e.g., brass, copper, or stainless steel, or plastic. Furthermore, the cross-sectional shape of the raw material 1 is not limited to be round, and can be polygonal, such as, e.g., square or hexagonal. The raw material 1 can be a rolled material or an extruded material, and also can be a material manufactured by other methods.

As shown in FIG. 1, the upsetting apparatus 1A is provided with a fixed die 20, two guides 31 and 32 for one side each having an insertion hole 34 for receiving and holding one side portion of the raw material 1 out of axial both side portions 3R and 3L thereof axially slidably in a buckling preventing state, a side guide 41 for the other side having an insertion hole 44 for receiving and holding the other side of the raw material 1 axially slidably in a buckling preventing state, a punch 50R for one side for pressurizing one side portion 3R of the raw material 1 in an axial direction, and a punch 50L for left side for pressurizing the other side portion 3L of the raw material 1 in an axial direction. In FIG. 1, "2" denotes an axial intermediate portion of the raw material 1.

In this embodiment, it is assumed that the raw material 1 is placed along a right-and-left direction as shown in FIG. 1. Hereafter, one side portion 3R of the raw material 1 out of the axial both side portions 3R and 3L thereof will be referred to as a "right side portion," and the other side portion 3L will be referred to as a "left side portion." In accordance with this, the guides 31 and 32 for one side will be referred to as a "right guide," and the guide 41 for the other side will be referred to as a "left guide," the punch 50R for one side will be referred to as a "right punch," and the punch 50L for the other side will be referred to as a "left punch."

The fixed die 20 is a member for fixing the raw material 1 so as not to move in the axial direction thereof at the time of the working. The fixed die 20 has a raw material fixing insertion hole 21 penetrated in the axial direction of the fixed die 20. The cross-sectional shape of this insertion hole 21 is a shape corresponding to the cross-sectional shape of the raw material 1, i.e., a circular shape. In this insertion hole 21, the axial intermediate portion 2 of the raw material 1 is to be inserted, so that the raw material 1 is secured thereto.

The fixed die 20 is comprised of a plurality of pieces (two pieces in this embodiment) divided by a dividing face vertically crossing the insertion hole 21, i.e., a split mold.

The two right guides 31 and 32 are to be arranged in the axial direction. In these right guides 31 and 32, the insertion hole 34 of each guide 31 and 32 is penetrated in the axial direction thereof. The insertion hole 34 has a cross-sectional shape corresponding to the cross-sectional shape of the right side portion 3R of the raw material 1, i.e., a circular cross-sectional shape, and is configured to axially slidably hold the right side portion 3R of the raw material 1 inserted in the insertion hole 34 in a buckling preventing state.

At this embodiment, out of two right guides 31 and 32, the guide 31 arranged at the front side will be referred to as a "first right guide", the guide 32 arranged at the rear side of this first right guide 31 will be referred to as a "second right guide."

The first right guide 31 guides the material of the right side portion 3R of the raw material 1 inserted in the insertion hole 34 to the side of the fixed die 20. More specifically, it guides the material to the free diameter expansion space formed between the first right guide 31 and the fixed die 20.

The second right guide 32 guides the material of the right side portion 3R of the raw material 1 inserted in the insertion hole 34 to the side of the first right guide 31. More specifically, it guides the material to the free diameter expansion space formed between the second right guide 32 and the first right guide 31.

The first right guide 31 can be divided into a plurality of pieces (e.g., two to four pieces) by a dividing face vertically crossing the insertion hole 34. Similarly, the second right guide 32 can be divided into a plurality of pieces (e.g., two to four pieces) by a dividing face vertically crossing the insertion hole 34. In the present invention, it is not always required that the second right guide 32 can be divided.

"25" denotes a holding die portion for holding the second right guide 32. This holding die portion 25 has a holding hole 25*a* in which the second right guide 32 is inserted and held in an axially movable manner.

In the same manner as in the right guides 31 and 32, the insertion hole 44 of the left guide 41 is penetrated in the axial direction of the left guide 41. This insertion hole 44 has a cross-sectional shape corresponding to the cross-sectional shape of the left side portion 3L of the raw material 1, i.e., a circular cross-sectional shape, and is configured such that the insertion hole 44 can hold the left side portion 3L of the raw material 1 inserted in the insertion hole 44 axially slidably in a buckling preventing state.

The left guide 41 guides the material of the left side portion 3L of the raw material 1 inserted in the insertion hole 34 to the side of the fixed die 20. More specifically, it guides this material into the free diameter expansion space formed between the left guide 41 and the fixed die 20.

Moreover, the right punch 50R is arranged at the right end side of the raw material 1, and the left punch 50L is arranged at the left end side of the raw material 1.

Furthermore, this upsetting apparatus 1A is equipped with two right guide driving apparatuses 61 and 62 (guide driving apparatus for one side), a left guide driving apparatus 63 (guide driving apparatus for the other side) and a right punch driving apparatus 70R (punch driving apparatus for one side portion), and a left punch driving apparatus 70L (punch driving apparatus for the other side).

Figure 2:
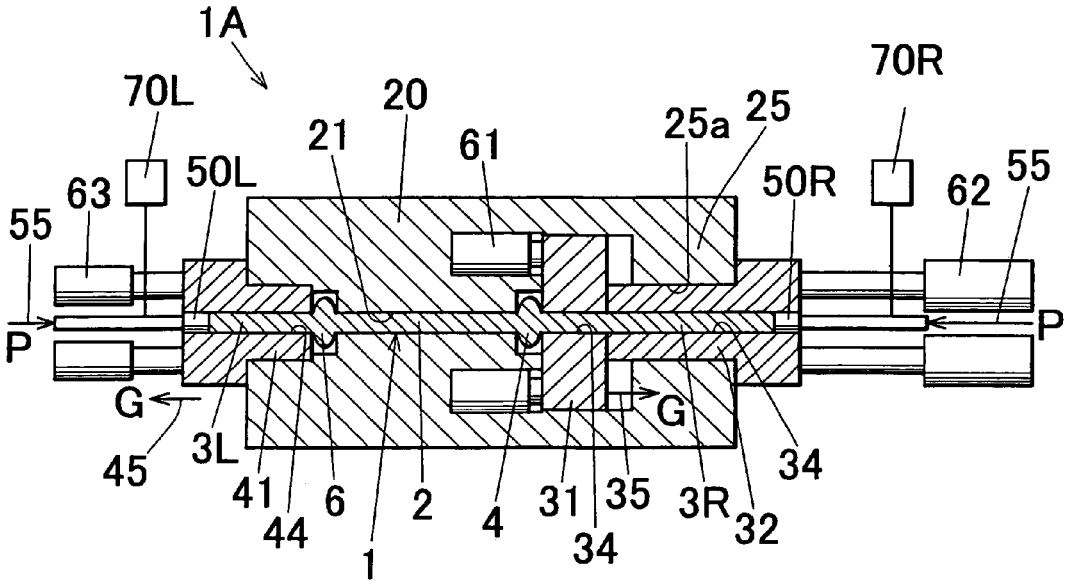
FIG. 2 is a vertical cross-sectional view of the principal part of the upsetting apparatus showing the state in which prescribed portions of the raw material is being expanded in diameter with the upsetting apparatus.

Each of the two right guide driving apparatuses 61 and 62 makes each of the right guides 31 and 32 move in a direction 35 opposite to the moving direction 55 of the right punch 50R (i.e., the pressing direction of the raw material right side portion 3R with the right punch 50R) (see FIG. 2). Each of the right guide driving apparatuses 61 and 62 are connected to the corresponding right guide 31 and 32.

Now, for the explanation purposes, out of the right guide driving apparatuses 61 and 62, the right guide driving apparatus 61 connected to the first right guide 31 will be referred to as a "first right guide driving apparatus," and the right guide driving apparatus 62 connected to the second right guide 32 will be referred to as a "second right guide driving apparatus."

Each of the right guide driving apparatuses 61 and 62 has a fluid pressure cylinder (hydraulic cylinder or gas-pressure cylinder) as a driving source, so that each of the corresponding right guides 31 and 32 are moved by the driving force of this cylinder.

In the present invention, each of the right guide driving apparatuses 61 and 62 can also be configured such that it moves the corresponding right guide 31 and 32 by, e.g., a machine cam, an electric motor, or a spring. When the target shape (designed shape) is determined, each of the right guide driving apparatuses 61 and 62 can move the corresponding right guide 31 and 32 at a constant speed, and therefore no apparatus for controlling the speed is required. However, it also becomes possible to arbitrarily change the upsetting shape (shape of the diameter expanded portion) by giving a control apparatus for controlling the traveling speed.

Figure 3:
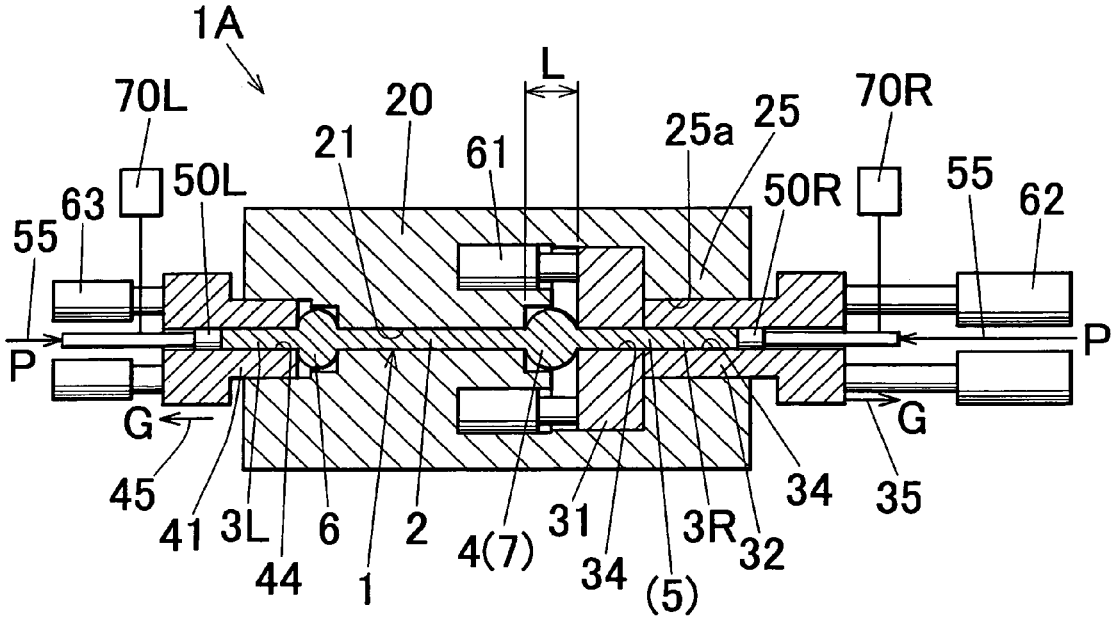
FIG. 3 is a vertical cross-sectional view of the principal part of the upsetting apparatus showing the state in which the prescribed portions of the raw material are being further expanded with the upsetting apparatus.

The left guide driving apparatus 63 moves the left guide 41 in a direction 45 opposite to the moving direction 55 of the left punch 50L (i.e., the pressing direction of the left side portion 3L of the raw material with the left punch 50L) (see FIG. 3). This left guide driving apparatus 63 is connected to the left guide 41. This left guide driving apparatus 63 has a fluid pressure cylinder as a driving source, so that the left guide 41 is moved with the driving force of this cylinder.

In the present invention, the left guide driving apparatus 63 can also be configured such that it moves the left guide 41 by, e.g., a machine cam, an electric motor, or a spring. When the target shape (designed shape) is determined, the left guide driving apparatus 63 can move the left guide 41 at a constant speed, and therefore no apparatus for controlling the speed is required. However, it also becomes possible to arbitrarily change the upsetting shape (shape of the diameter expanded portion) by giving a control apparatus for controlling the traveling speed.

The right punch driving apparatus 70R is for giving a pressing force for moving the right punch 50R in the axial direction of the raw material 1 to thereby give a pressing force for pressurizing the right side portion 3R of the raw material 1 to the right punch 50R. This right punch driving apparatus 70R is connected to the right punch 50R to give a driving force to the right punch 50R by a fluid pressure (e.g., oil pressure, gas pressure). When the target shape (designed shape) is determined, the right punch driving apparatus 70R can move the right punch 50R at a constant speed, and therefore no apparatus for controlling the speed is required. However, it also becomes possible to arbitrarily change the upsetting shape (shape of the diameter expanded portion) by giving a control apparatus for controlling the traveling speed.

The left punch driving apparatus 70L is for moving the left punch 50L in the axial direction of the raw material 1 to thereby give a pressing force for pressurizing the left side portion 3L of the raw material 1 to the left punch 50L. This left punch driving apparatus 70L is connected to the left punch 50L to give a driving force to the left punch 50L by a fluid pressure (e.g., oil pressure, gas pressure). When the target shape (designed shape) is determined, the left punch driving apparatus 70L can move the left punch 50L at a constant speed, and therefore no apparatus for controlling the speed is required. However, it also becomes possible to arbitrarily change the upsetting shape (shape of the diameter expanded portion) by giving a control apparatus for controlling the traveling speed.

Next, an upsetting method using the upsetting apparatus 1A will be explained as follow.

Initially, as shown in FIG. 1, the axial intermediate portion 2 of the raw material 1 is inserted into the raw material fixing insertion hole 21 of the fixed die 20. Thus, the raw material 1 is secured so as not to move unintentionally at the axial intermediate portion 2.

Furthermore, the right side portion 3R of the raw material 1 is inserted into each insertion hole 34 and 34 of the two right guides 31 and 32 in this order to thereby axially slidably hold the right side portion 3R of the raw material 1 in a buckling preventing state.

The left side portion 3L of the raw material 1 is inserted into the insertion hole 44 of the left guide 41 to thereby axially slidably hold the left side portion 3L of the raw material 1 in a buckling preventing state. In this state, both the right guides 31 and 32 are arranged in the axial direction.

Furthermore, an initial clearance X is formed between the first right guide 31 and the fixed die 20. The distance of this initial clearance X is set to be not larger than the buckling limit length $X_0$ (preferably less than the buckling limit length $X_0$) at the cross-sectional area of the first exposed portion 4 of the raw material 1 exposed between the first right guide 31 and the fixed die 20 in a state before the initiation of the movement of the right punch 50R (i.e., the pressurizing of the right side portion 3R of the raw material 1 with the right punch 50R). In the present invention, the buckling limit length means the buckling limit length under the punch pressing force.

In the same manner as mentioned above, an initial clearance X is formed between the left guide 41 and the fixed die 20. The distance of this initial clearance X is set to be not larger than the buckling limit length $X_0$ (preferably less than the buckling limit length $X_0$) at the cross-sectional area of the third exposed portion 6 of the raw material 1 exposed between the left guide 41 and the fixed die 20 in a state before the initiation of the movement of the left punch 50L (i.e., the pressurizing of the left side portion 3L of the raw material 1 with the left punch 50L).

Subsequently, as shown in FIG. 2, while pressurizing the right side portion 3R of the raw material 1 in the axial direction with the right punch 50R by moving the right punch 50R through the operation of the right punch driving apparatus 70R, the two right guide driving apparatuses 61 and 62 are operated to move the two right guides 31 and 32 in a direction 35 opposite to the moving direction 55 of the right punch 50R in a mutually adhered manner. Thereby, the first exposed portion 4 of the raw material 1 exposed between the first right guide 31 and the fixed die 20 is expanded in diameter in a non-restrained manner, i.e., in the state in which the peripheral surface of the first exposed portion 4 is not restrained.

Moreover, the left punch 50L is moved simultaneously with the right punch 50R by operating the left punch driving apparatus 70L simultaneously with the right punch driving apparatus 70R. By this, while pressurizing the left side portion 3L of the raw material 1 in the axial direction with the left punch 50L simultaneously with the pressurizing of the right side portion 3R of the raw material 1 with the right punch 50R, the left guide 41 is moved in a direction 45 opposite to the moving direction 55 of the left punch 50L by operating the left guide driving apparatus 63. By this, the third exposed portion 6 of the raw material 1 exposed between the left guide 41 and the fixed die 20 is expanded in diameter in a non-restrained manner, i.e., in the state in which the peripheral surface of the third exposed portion 6 is not restrained.

Here, it is preferable to set a time lag to between the moving initiation of the right punch 50R and the moving initiation of the first right guide 31. That is, when the pressurizing of the right side portion 3R of the raw material 1 with the right punch 50R is initiated, as shown in FIG. 2, with the position of the first right guide 31 fixed to the initial position, the right punch 50R is moved to pressurize the right side portion 3R of the raw material 1 in the axial direction with the right punch 50R. After passing the time lag to, both the right guides 31 and 32 are moved in a prescribed direction 35 in a mutually adhered manner while continuously pressurizing the right side portion 3R of the raw material 1 with the right punch 50R. The traveling speed of both the right guides 31 and 32 at this time is controlled by the control apparatus of both the right guide driving apparatuses 61 and 62 so that the length of the first exposed portion 4 of the raw material 1 becomes not larger than the buckling limit length (preferably less than the buckling limit length) at the cross-sectional area of the first exposed portion 4 of the raw material 1.

In the same manner as mentioned above, it is preferable to set a time lag $t_0$ between the moving initiation of the left punch 50L and the moving initiation of the left guide 41. That is, when the pressurizing of the left side portion 3L of the raw material 1 with the left punch 50L is initiated, with the position of the left guide 41 fixed to the initial position, the left punch 50L is moved to pressurize the left side portion 3L of the raw material 1 in the axial direction with the left punch 50L. After passing the time lag to, the left guide 41 is moved in a prescribed direction 45 while continuously pressurizing the left side portion 3L of the raw material 1 with the left punch 50L. The traveling speed of the left guide 41 at this time is controlled by the control apparatus of the left guide driving apparatus 63 so that the length of the third exposed portion 6 of the raw material 1 becomes not larger than the buckling limit length (preferably less than the buckling limit length) at the cross-sectional area of the third exposed portion 6 of the raw material 1.

The time lag to is given by $t_0=V_0/(SP)$, where the increment volume of the raw material 1 which increases between the time lag $t_0$ in the range of the initial clearance X is $V_0$, the average moving speed of the right punch 50R (or the left punch 50L) from the moving initiation is P, and the cross-sectional area of the right side portion 3R (or the left side portion 3L) of the raw material 1 before executing the upsetting is S.

In the present invention, the traveling speed of the right punch 50R can be constant, or can be variable. Similarly, the traveling speed of both the right guides 31 and 32 can be constant, or can be variable.

In the same manner as mentioned above, the traveling speed of the left punch 50L can be constant, or can be variable. Similarly, the traveling speed of the left guide 41 can be constant, or can be variable.

In accordance with the movement of the right punch 50R and both the right guides 31 and 32, the first exposed portion 4 of the raw material 1 is expanded in diameter gradually in a non-restrained state in the free diameter expansion space formed between the first right guide 31 and the fixed die 20.

In the same manner, in accordance with the movement of the left punch 50L and the left guide 41, the third exposed portion 6 of the raw material 1 is expanded in diameter gradually in a non-restrained state in the free diameter expansion space formed between the left guide 41 and the fixed die 20.

And as shown in FIG. 3, when the first right guide 31 out of both the right guides 31 and 32 has reached the predetermined stop position, the movement of the first right guide 31 is stopped (terminated). At this time, the first exposed portion 4 of the raw material 1 has been expanded in diameter into a designed shape, i.e., approximately spherical shape (or approximately spindle shape) "7" denotes a first diameter expanded portion (see FIG. 5) formed by expanding the first exposed portion 4.

Subsequently, while continuously pressurizing the right side portion 3R of the raw material 1 with the right punch 50R, only the second right guide 32 is moved in a direction 35 opposite to the moving direction 55 of the right punch 50R. Thereby, the second exposed portion 5 of the raw material 1 exposed between the second right guide 32 and the first right guide 31 is expanded in diameter in a non-restrained state in the free diameter expansion space formed between the second right guide 32 and the first right guide 31.

Figure 4:
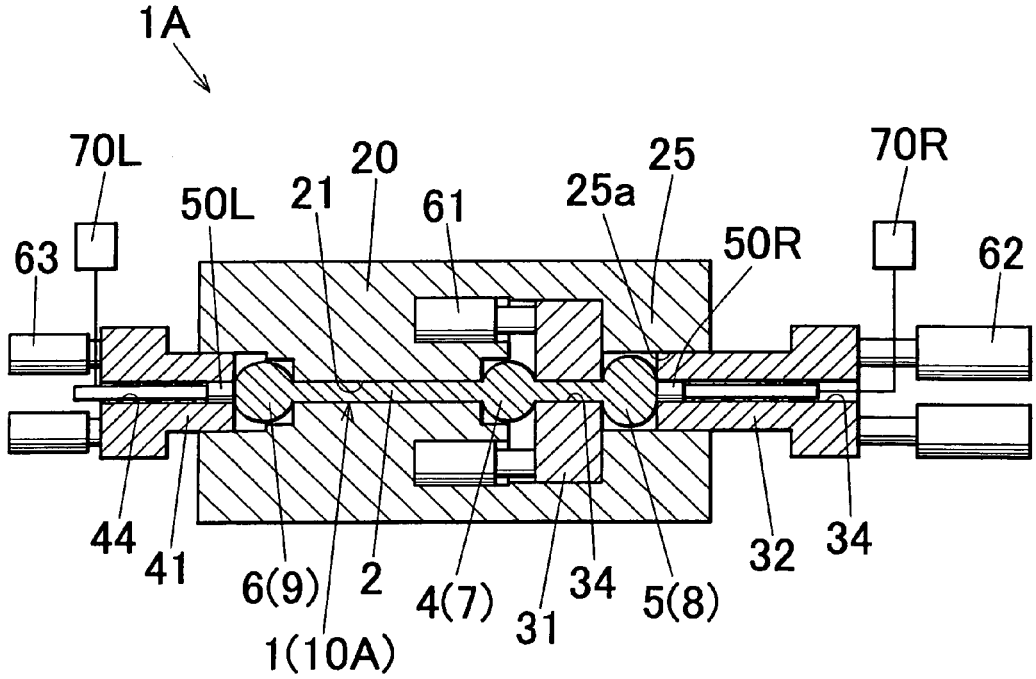
FIG. 4 is a vertical cross-sectional view of the principal part of the upsetting apparatus showing the state after expanding the prescribed portions of the raw material with the upsetting apparatus.

As shown in FIG. 4, when the second right guide 32 has reached the designed stop position, the movement of the second right guide 32 and the movement of the right punch 50R are stopped (terminated). At this time, the second exposed portion 5 of the raw material 1 has been expanded into a designed shape, i.e., an approximately spherical shape (or approximately spindle shape). "8" is a second diameter expanded portion (see FIG. 5) formed by expanding the second exposed portion 5.

On the other hand, as shown in this figure, when the left guide 41 has reached the designed stop position, the movement of the left guide 41 and the movement of the left punch 50L are stopped (terminated). At this time, the third exposed portion 6 of the raw material 1 has been expanded into a designed shape, i.e., an approximately spherical shape (or approximately spindle shape). "9" is a third diameter expanded portion (see FIG. 5) formed by expanding the third exposed portion 6.

It is preferable that the stop time of the movement of the left guide 41 and the stop time of the movement of the second right guide 32 coincide with each other. This enables reduction of force required to secure the raw material 1 with the fixed die (i.e., raw material fixing force), resulting in a reduced reaction force which acts on the fixed die 20 at the time of the working.

The upsetting of the raw material 1 at three portions is completed by the above procedures.

Subsequently, the raw material 1 is taken out of the insertion hole 21 of the fixed die 20 and the insertion hole 34 and 44 of each guide 31, 32, and 41. Thus, an upsetting manufactured product 10A shown in FIG. 5 can be obtained. At this time, since the first right guide 31 can be divided, the upsetting manufactured product 10A can be easily removed from the insertion hole 34 of the first right guide 31 by dividing the first right guide 31 at the time of the removal.

This upsetting manufactured product 10A can be used as a preform for manufacturing a straight arm for vehicles, such as, e.g., automobiles or railroad vehicles (i.e., a preform for vehicle arms). In this case, each diameter expanded portion 7 of the upsetting manufactured product 10A can be used as a joint portion (for example, a bush mounting portion) to be connected to other components. Furthermore, this upsetting manufactured product 10A can also be used as, e.g., a preform for steering knuckle arms by bending into a circular shape, or the like.

It should be noted that the upsetting apparatus and the upsetting method according to the present invention are not limited to an apparatus or a method for manufacturing a preform for vehicle arms, and can also be used for manufacturing a preform for various products.

Thus, in the aforementioned upsetting of the first embodiment, diameter expansion of the right side portion 3R of the raw material 1 can be performed at two portions without reversing the raw material 1, which enables efficient diameter expansion working.

Furthermore, diameter expansion working at one portion of the left side portion 3L of the raw material 1 can be performed simultaneously with diameter expansion working at two portions of the right side portion 3R of the raw material 1, which enables efficient diameter expansion working at a total of three portions of the raw material 1.

Furthermore, since each exposed portion 4, 5 and 6 of the raw material 1 is expand in diameter in a non-restrained manner, each exposed portion 4, 5 and 6 can be expanded in diameter with a low punch pressing force, resulting in a reduced driving force required for driving each punch 50R and 50L. Furthermore, since the diameter expansion of the exposed portions 4, 5 and 6 can be performed without using an expensive molding die having molding dented portions, the manufacturing cost can be reduced.

Next, preferable processing conditions for the upsetting method of the first embodiment will be explained below.

Hereinafter,

"P" denotes an average moving speed of the right punch 50R from the moving initiation thereof, "G" denotes an average moving speed of the first right guide 31 from the moving initiation thereof, "$X_0$" denotes a buckling limit length at the cross-sectional area of the raw material 1 before the upsetting, "$X_1$" denotes a buckling limit length at the cross-sectional area of the first diameter expanded portion 7 to be formed by the diameter expansion of the first exposed portion 4 of the raw material 1, "X" denotes an initial clearance between the first right guide 31 and the fixed die 20 ($0 \leqq X \leqq X_0$), "$t_0$" denotes a time lag from the moving initiation of the right punch 50R to the moving initiation of the first right guide 31 ($0 \leqq t_0$), "L" denotes a length of the first diameter expanded portion 7, "$l_0$" denotes a length of the raw material 1 before executing the upsetting required for the first diameter expanded portion 7, and "T" denotes an upsetting time from the moving initiation of the right punch 50R.

In the case of $t_0 < T$, it is preferable that "G" satisfies the following relational expression:

$$0 \leqq G \leqq P(X_1 - X)/(l_0 - X_1 - Pt_0) \quad \text{(i)}$$

When G satisfies the aforementioned relational expression (i), the buckling which may sometimes occur at the time of the diameter expansion working of the first exposed portion 4 can be prevented assuredly.

The reason that the aforementioned relational expression (i) is set about "G" will be explained below.

<Lower Limit of G>

Since X satisfies the relational expression of $0 \leqq X \leqq X_0$, when G is 0, the first exposed portion 4 of the raw material 1 will not be buckled. Therefore, the lower limit of G is 0. However, when G is 0, the punch pressing force required for the diameter expansion of the first exposed portion 4 cannot be decreased. Therefore, G must be zero or more, i.e., the following expression is established.

$$0 \leqq G \quad \text{(i-a)}$$

Furthermore, it is especially preferable that the following relational expression (i-b) is satisfied.

$$(L - X)/\{(l_0 - L)/P - t_0\} \leqq G \quad \text{(i-b)}$$

Since "G" satisfies the aforementioned relational expression (i-b), not only buckling which may occur at the time of diameter expansion working of the first exposed portion 4 can be satisfied, but also the first exposed portion 4 can be assuredly expanded into a designed shape.

The reason is as follows. That is, when the first exposed portion 4 is expanded into a designed shape, a time $(l_0 - L)/P$ required for becoming L from $l_0$ by the pressing force of the right punch 50R, and a time $\{(L - X)/G\} + t_0$ required for becoming L from X in the distance between the first right guide 31 and the fixed die 20 by the movement of the first right guide 31 should be the same. Therefore, it is especially preferable that "G" satisfies the relational expression (i-b).

<Upper Limit of G>

The conditions of the upper limit of G are that the length of the first exposed portion 4 of the raw material 1 is not longer than the buckling limit length at the cross-sectional area of the first exposed portion 4 of the raw material 1 in the case where the position of the front end portion of the first right guide 31 and the position of the rear end portion of the raw material 1 before executing the upsetting required for the first diameter expanded portion 7 at the length $l_0$ from the fixed die 20 coincide each other.

However, when the position of the front end portion of the first right guide 31 and the position of the rear end portion of $l_0$ coincide with each other, the following expression (i-c) is established.

$$l_0 - PT = X + G(T - t_0) \quad \text{(i-c)}$$

From this equation (i-c), "T" is given by the following expression (i-d).

$$T = \{l_0 - X + Gt_0\}/(G + P) \quad \text{(i-d)}$$

In order to prevent the buckling of the first exposed portion 4 of the raw material 1, the length $X+G(T-t_0)$ of the first exposed portion 4 of the raw material 1 when the position of the front end portion of the first right guide 31 and the position of the rear end portion of $l_0$ coincide with each other should be not larger than the buckling limit length $X_1$ at the cross-sectional area of the first diameter expanded portion 7 of the raw material 1. Therefore, the following expression (i-e) is established.

$$X+G(T-t_0)\leqq X_1 \quad \text{(i-e)}$$

By substituting the equation (i-d) for the equation (i-e) and arranging about G, the following relational expression (i-f) is derived.

$$G\leqq P(X_1-X)/(l_0-X_1-Pt_0) \quad \text{(i-f)}$$

From the equation (i-a) and the equation (i-f), the relational expression (i) is derived.

As a matter of course, when $0\leqq T\leqq t_0$, G is G=0.

Furthermore, it is especially preferable that the time lag $t_0$ is $0<t_0$. The reasons are as follows. That is, since $0<t_0$, immediately after the initiation of the movement of the right punch 50R, the cross-sectional area of the first exposed portion 4 of the raw material 1 exposed in the range of the initial clearance X between the first right guide 31 and the fixed die 20 increases. Therefore, the buckling limit length in the first exposed portion 4 of the raw material 1 can be lengthened, with more assured prevention of buckling.

Furthermore, in the present invention, in cases where the cross-sectional area of the first diameter expanded portion 7 of the raw material 1 is not constant in the axial direction after the upsetting, it is preferable to adopt the cross-sectional area considering the shape of the first diameter expanded portion 7 as the cross-sectional area of the first diameter expanded portion 7 of the raw material 1 after the upsetting. For example, it is preferable to adopt an average cross-sectional area of the first diameter expanded portion 7. Alternatively, the minimum cross-sectional area of the first diameter expanded portion 7 can be adopted, or the maximum cross-sectional area of the first diameter expanded portion 7 can be adopted.

The relational expression (i) can also be applied to the left guide 41 by replacing the left guide 41, the third exposed portion 6, the third diameter expanded portion 9, and the left punch 50L with the first right guide 31, the first exposed portion 4, the first diameter expanded portion 7, and the right punch 50R, respectively, in the aforementioned relational expression (i). By this, the buckling which may sometimes occur at the time of the diameter expansion working of the third exposed portion 6 can be prevented assuredly.

In the first embodiment, the opening edge portion of the insertion hole 34 and 44 of each guide 31, 32, and 41 can be chamfered.

FIGS. 6 to 9 are schematic explanatory views of an upsetting method using an upsetting apparatus according to a second embodiment of the present invention.

In FIG. 1, "1B" denotes an upsetting apparatus according to the second embodiment, and "1" denotes a raw material. Moreover, in FIG. 9, "10B" denotes an upsetting manufactured product 1B manufactured by an upsetting apparatus 1B. This upsetting manufactured product 10B has approximately columnar diameter expanded portions 7, 8 and 9 formed at three portions of a bar-shaped shank.

Hereinafter, the structure of the upsetting apparatus 1B of the second embodiment will be explained focusing on the differences between the upsetting apparatus 1A of the first embodiment and that of this embodiment.

Figure 6:
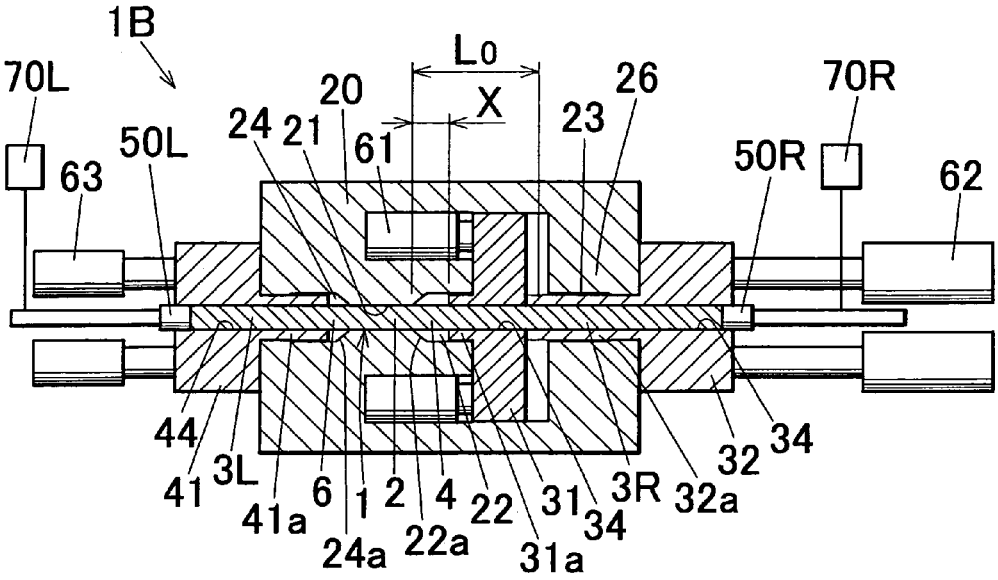
FIG. 6 is a vertical cross-sectional view of a principal part of an upsetting apparatus showing the state before expanding prescribed portions of a raw material with the upsetting apparatus according to a second embodiment of the present invention.

As shown in FIG. 6, the raw material 1 is a straight bar-shaped raw material like the first embodiment, and the cross-sectional shape is round.

In the upsetting apparatus 1B of this second embodiment, a first molding dented portion 22 is formed at the axial right end portion of the fixed die 20. Moreover, a third molding dented portion 24 is formed at the axial left end portion of the fixed die 20. Furthermore, this upsetting apparatus 1B is equipped with a molding die portion 26 placed at the rear side of the first right guide 31. This molding die portion 26 has a second molding dented portion 23.

Furthermore, at the front end portion of the first right guide 31, a first male die portion 31*a* capable of being fitted in the first molding dented portion 22 is protruded forwardly. At the front end portion of the second right guide 32, a second male die portion 32*a* capable of being fitted in the second molding dented portion 23 is protruded forwardly. Moreover, at the front end portion of the left guide 41, a third male die portion 41*a* capable of being fitted in the third molding dented portion 24 is protruded forwardly.

The other structure of this upsetting apparatus 1B is the same as that 1A of the first embodiment.

Next, the upsetting method using this upsetting apparatus 1B will be explained below focusing on the difference between the upsetting method of the first embodiment and that of this embodiment.

First, as shown in FIG. 6, the axial intermediate portion 2 of the raw material 1 is inserted and held in the raw material fixing insertion hole 21 of the fixed die 20, the right side portion 3R of the raw material 1 is placed in the first molding dented portion 22 and the second molding dented portion 23, and the left side portion 3L of the raw material 1 is placed in the third molding dented portion 24.

Moreover, the right side portion 3R of the raw material 1 is inserted and held in each insertion hole 34 and 34 of the two right guides 31 and 32 in order. Furthermore, the first male die portion 31*a* of the first right guide 31 is inserted and held in the first molding dented portion 22, and the second male die portion 32*a* of the second right guide 32 is inserted and held in the second molding dented portion 23.

Moreover, the left side portion 3L of the raw material 1 is inserted and held in the insertion hole 44 of the left guide 41. Then, the third male die portion 41*a* of this left guide 41 is fitted in the third molding dented portion 24.

Furthermore, it is preferable to provide an initial clearance X between the front end portion of the first right guide 31 (in detail, the front end portion of the first male die portion 31*a*) and the bottom portion 22*a* of the first molding dented portion 22. The distance of this initial clearance X has been set to be not larger than the buckling limit length $X_0$ (preferably, less than the buckling limit length $X_0$) at the cross-sectional area of the first exposed portion 4 of the raw material 1 exposed between the front end portion of the first right guide 31 and the bottom portion 22*a* of the first molding dented portion 22 in the state before initializing the movement of the right punch 50R (i.e., pressurizing of the right side portion 3R of the raw material 1 with the right punch 50R).

Moreover, it is preferable to provide an initial clearance X between the front end portion of the left guide 41 (in detail, the front end portion of the third male die portion 41*a*) and the bottom portion 24*a* of the third molding dented portion 24. The distance of this initial clearance X has been set to be not larger than the buckling limit length $X_0$ at the cross-sectional area of the third exposed portion 6 of the raw material 1 exposed between the front end portion of the left guide 41 and the bottom portion 24*a* of the third molding dented portion 24 in the state before initializing the movement of the left punch 50L (i.e., pressurizing of the left side portion 3L of the raw material 1 with the left punch 50L).

Figure 7:
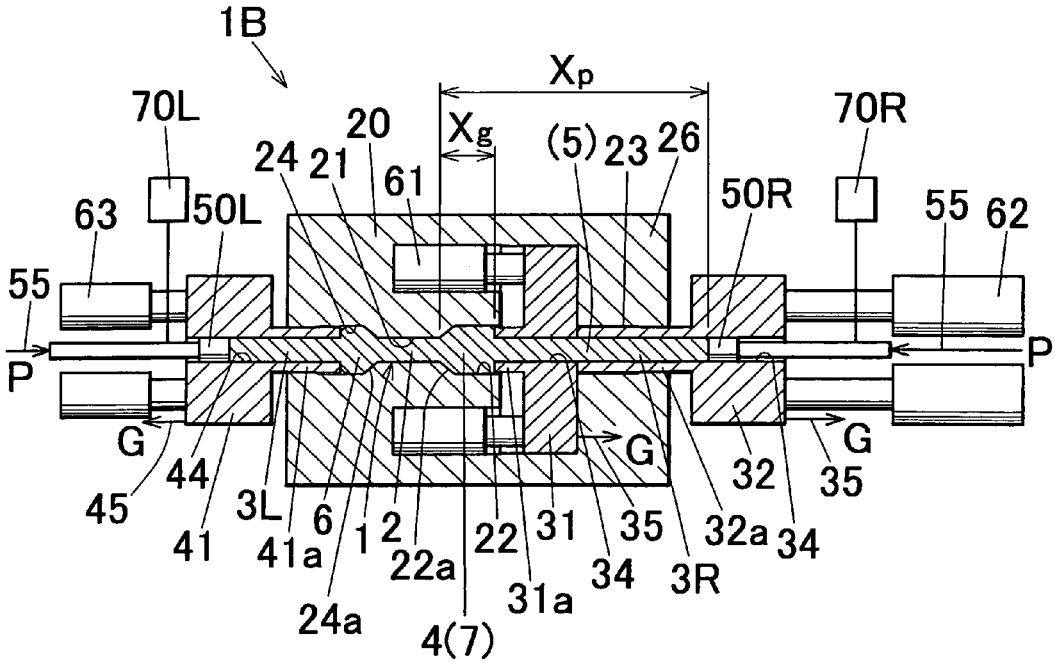
FIG. 7 is a vertical cross-sectional view of the principal part of the upsetting apparatus showing the state in which the prescribed portions of the raw material are being expanded in diameter with the upsetting apparatus.

Next, while pressurizing the right side portion 3R of the raw material 1 in the axial direction with the right punch 50R by moving the right punch 50R through the operation of the right punch driving apparatus 70R, the two right guides 31 and 32 are moved in a direction 35 opposite to the moving direction 55 of the right punch 50R with the two right guides 31 and 32 mutually adhered by operating the two right guide driving apparatus 61 and 62 (see FIG. 7). Thereby, the first exposed portion 4 of the raw material 1 exposed between the front end portion of the first right guide 31 and the bottom portion 22*a* of the first molding dented portion 22 is expanded in the first molding dented portion 22, i.e., in the state in which the entire peripheral surface of the first exposed portion 4 is restrained by the peripheral surface of the first molding dented portion 22.

Moreover, the left punch 50L is moved by operating the left punch driving apparatus 70L simultaneously with the right punch driving apparatus 70R. Thereby, while pressurizing the left side portion 3L of the raw material 1 in the axial direction with the left punch 50L simultaneously with the pressurizing of the right side portion 3R of the raw material 1 with the right punch 50R, the left guide 41 is moved in a direction 45 opposite to the moving direction 55 of the left punch 50L. Thereby, the third exposed portion 6 of the raw material 1 exposed between the front end portion of the left guide 41 and the bottom portion 24*a* of the third molding dented portion 24 is expanded in the third molding dented portion 24, i.e., in the state in which the entire peripheral surface of the third exposed portion 6 is restrained by the peripheral surface of the third molding dented portion 24.

Here, it is preferable to provide a time lag to between the moving initiation of the right punch 50R and the moving initiation of the first right guide 31.

Moreover, in the same manner as mentioned above, it is preferable to provide a time lag $t_0$ between the moving initiation of the left punch 50L and the moving initiation of the left guide 41.

In accordance with the movements of the right punch 50R and both the right guides 31 and 32, the first exposed portion 4 of the raw material 1 is gradually expanded in diameter in the first molding dented portion 22.

Similarly, in accordance with the movements of the left punch 50L and the left guide 41, the third exposed portion 6 of the raw material 1 is gradually expanded in diameter in the third molding dented portion 24.

As shown in FIG. 7, when the first right guide 31 has reached the set stop position, the movement of the first right guide 31 is stopped (terminated). At this time, the first exposed portion 4 of the raw material 1 has been expanded into a designed shape, i.e., an approximately columnar shape, in the first molding dented portion 22. "7" is a first diameter expanded portion formed by the diameter expansion of the first exposed portion 4 (see FIG. 9).

Subsequently, while continuously pressurizing the right side portion 3R of the raw material 1 with the right punch 50R, only the second right guide 32 is moved in a direction 35 opposite to the moving direction 55 of the right punch 50R. Thereby, the second exposed portion 5 of the raw material 1 exposed between the front end portion of the second right guide 32 (in detail, the front end portion of the second male die portion 32*a*) and the first right guide 31 is expanded in diameter in the second molding dented portion 23.

Figure 8:
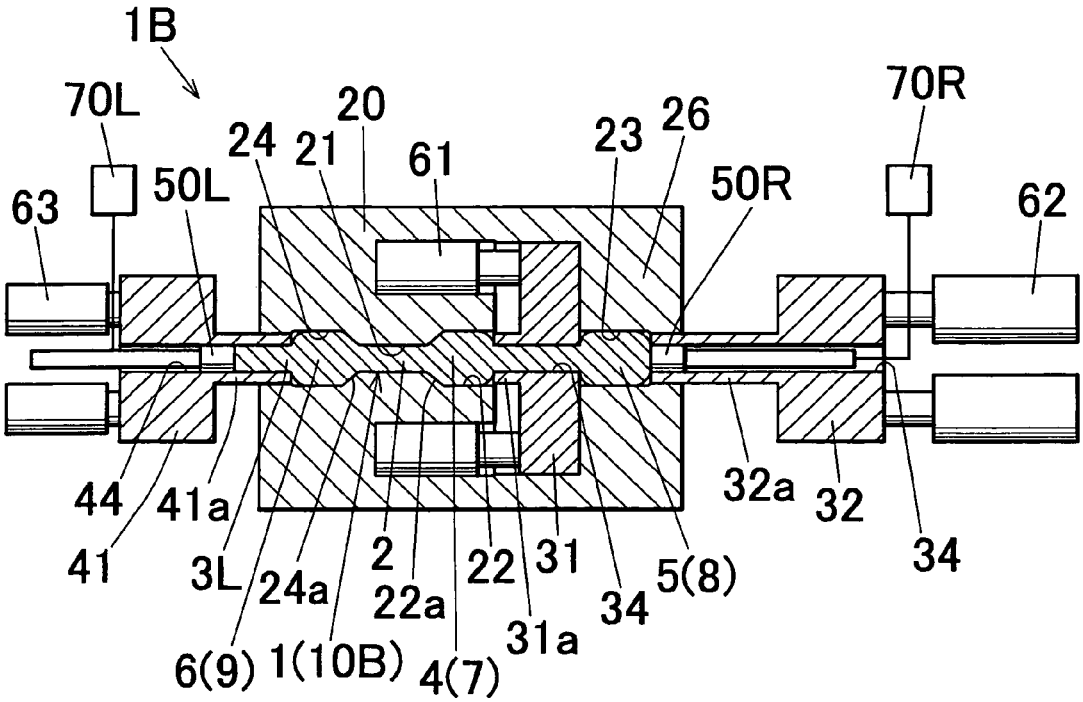
FIG. 8 is a vertical cross-sectional view of the principal part of the upsetting apparatus showing the state after expanding the prescribed portions of the raw material with the upsetting apparatus.

And, as shown in FIG. 8, when the second right guide 32 has reached the designed stop position, the movement of the second right guide 32 and the movement of the right punch 50R are stopped (terminated). At this time, the second exposed portion 5 of the raw material 1 has been designed shape, i.e., an approximately columnar shape, in the second molding dented portion 23. "8" denotes a second diameter expanded portion formed by the diameter expansion of the second exposed portion 5 (see FIG. 9).

On the other hand, as shown in this figure, when the left guide 41 has reached the designed stop position, the movement of the left guide 41 and the movement of the left punch 50L are stopped (terminated). At this time, the third exposed portion 6 of the raw material 1 has been expanded in diameter into a designed shape, i.e., an approximately columnar shape, in the third molding dented portion 24. "9" denotes a third diameter expanded portion formed by the diameter expansion of the third exposed portion 6 (see FIG. 9).

It is preferable that the stop time of the movement of the left guide 41 and that of the second right guide 32 coincide with each other.

Through the aforementioned procedures, the upsetting of the raw material 1 at three portions is completed.

Subsequently, the raw material 1 is removed from the insertion hole 21 of the fixed die 20 and the insertion hole 34 and 44 of each guide 31, 32 and 41, to thereby obtain the prescribed upsetting manufactured product 10B shown in FIG. 9.

This upsetting manufactured product 10B can be used as a preform for, e.g., vehicle arms in the same manner as the upsetting manufactured product 10A of the first embodiment.

It should be noted that the upsetting apparatus and the upsetting method according to the present invention are not limited to an apparatus and a method for manufacturing a preform for vehicle arms, and can be used for manufacturing a preform for various products.

In the upsetting of the second embodiment, since each exposed portion 4, 5 and 6 of the raw material 1 is expanded in diameter in the corresponding molding dented portion 22, 23 and 24, a diameter expanded portion 7, 8 and 9 of a designed shape can be formed assuredly.

Next, preferable processing conditions in the upsetting method of this second embodiment will be explained below.

Hereinafter, "P" denotes an average moving speed of the right punch 50R from the moving initiation thereof, "G" denotes an average moving speed of the first right guide 31 from the moving initiation thereof, "$X_0$" denotes a buckling limit length at the cross-sectional area of the raw material 1 before the upsetting, "X" denotes an initial clearance between the front end portion of the first right guide 31 and the bottom portion 22*a* of the first molding dented portion 22 ($0 \leqq X \leqq X_0$), "$L_0$" denotes a length of the raw material before the upsetting required for the first diameter expanded portion 7 formed by the diameter expansion of the first exposed portion 4, "$X_P$" denotes a stop position of the tip end portion of the right punch 50R with respect to the bottom portion 22*a* of the first molding dented portion 22 obtained from the design volume of the first diameter expanded portion 7, "$X_g$" denotes a designed stop position of the front end portion of the first right guide 31 with respect to the bottom portion 22*a* of the first molding dented portion 22, and "$t_0$" denotes a time lag from the moving initiation of the right punch 50R to the moving initiation of the first right guide 31 ($0 \leqq t_0$).

In this upsetting method, it is preferable that "G" satisfies the following expression (ii).

$$G=P(X_g-X)/(L_0-X_P-Pt_0) \quad \text{(ii)}$$

When "G" satisfies the equation (ii), the first exposed portion 4 can be assuredly expanded in diameter into a designed shape.

The reason for setting the equation (ii) about G will be explained below.

When "t" defines a time from the moving initiation of the right punch 50R to the diameter expansion termination of the first exposed portion 4 (i.e., the processing time for the first exposed portion 4), the distance between the front end portions of the right punch 50R and the bottom portion 22*a* of the first molding dented portion 22 at the time of the diameter expansion working termination of the first exposed portion 4, i.e., the position $X_P$ of the front end portion of the right punch 50R with respect to the bottom portion 22*a* of the first molding dented portion 22 can be given by the following formula (ii-a).

$$L_0-Pt=X_P \quad \text{(ii-a)}$$

$$\therefore t=(L_0-X_P)/P \quad \text{(ii-b)}$$

Moreover, the distance between the front end portions of the first right guide 31 and the bottom portion 22*a* of the first molding dented portion 22 at the time of the diameter expansion working termination of the first exposed portion 4, i.e., the position $X_P$ of the front end portion of the first right guide 31 with respect to the bottom portion 22*a* of the first molding dented portion 22, can be given by the following formula (ii-c).

$$X+G(t-t_0)=X_g \quad \text{(ii-c)}$$

By substituting the equation (ii-b) for the equation (ii-c) and arranging about G, the aforementioned equation (ii) is derived.

In the second embodiment, the opening edge portion of the insertion hole 34 and 44 of each guide 31, 32 and 41 can be chamfered.

FIGS. 10 to 13 are schematic views for explaining an upsetting method using an upsetting apparatus according to a third embodiment of the present invention.

Figure 10:
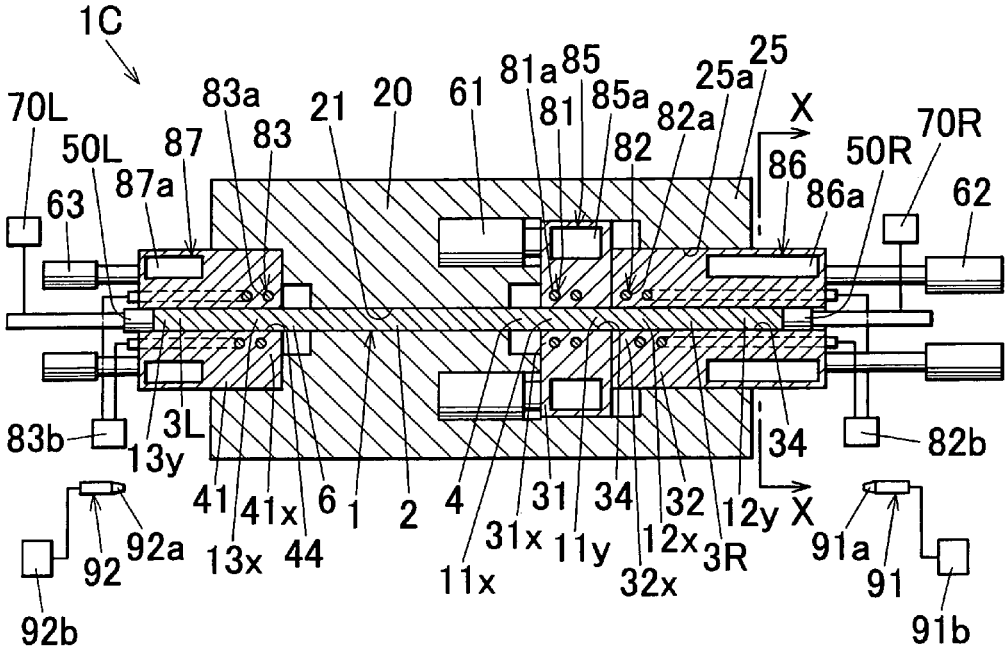
FIG. 10 is a vertical cross-sectional view of a principal part of an upsetting apparatus showing the state before expanding prescribed portions of a raw material with the upsetting apparatus according to a third embodiment of the present invention.

In FIG. 10, "1C" denotes an upsetting apparatus according to the third embodiment. In FIG. 10, the same reference numeral/mark is allotted to the same structural element as the structural element of the upsetting apparatus 1A according to the first embodiment shown in FIGS. 1 to 5. Hereafter, the structure of the upsetting apparatus 1C of this third embodiment will be explained focusing on the differences between this apparatus and the upsetting apparatus 1A of the first embodiment.

Figure 5:
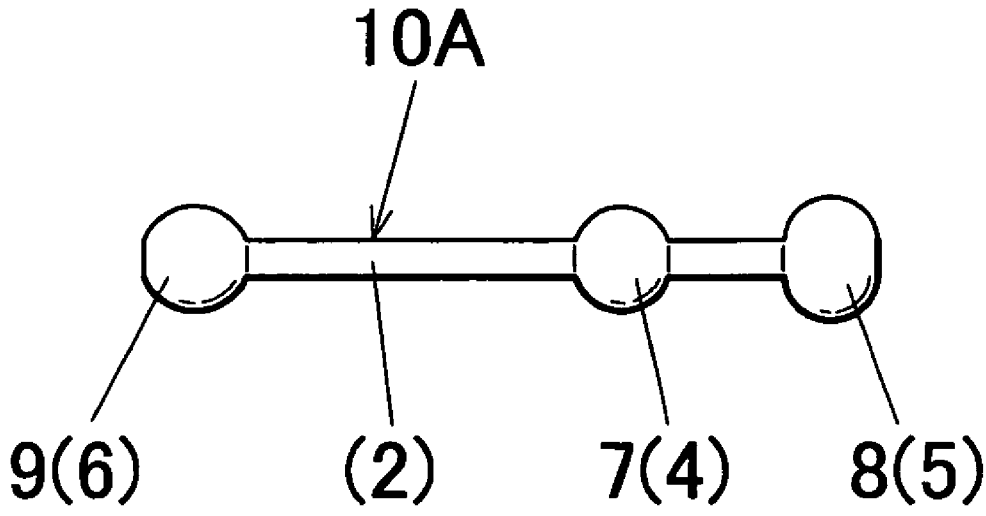
FIG. 5 is a plan view of an upsetting manufactured product obtained using the upsetting apparatus.

The upsetting manufactured product to be manufactured by the upsetting apparatus 1C of the third embodiment is the same as the upsetting manufactured product 10A shown in FIG. 5.

In the third embodiment, a raw material 1 is a round bar-shaped material, in detail, a columnar bar-shaped material. Furthermore, this raw material 1 is a rolled material manufactured by, e.g., being rolled with reduction rolls into a round bar-shape, i.e., manufactured by roll forming. Furthermore, in detail, this raw material 1 is a cast rolled material, more specifically, a continuously cast rolled material manufactured by a known Properzi method. However, in the present invention, a rolled material is not limited to a continuously cast rolled material manufactured by a Properzi method, and can be a rolled material manufactured by other methods.

The cast rolled material means, for example, a material manufactured by rolling a cast. In this case, as the cast, for example, a cast obtained by a known casting method, such as, e.g., a one-way solidification casting, can be used.

Figure 11:
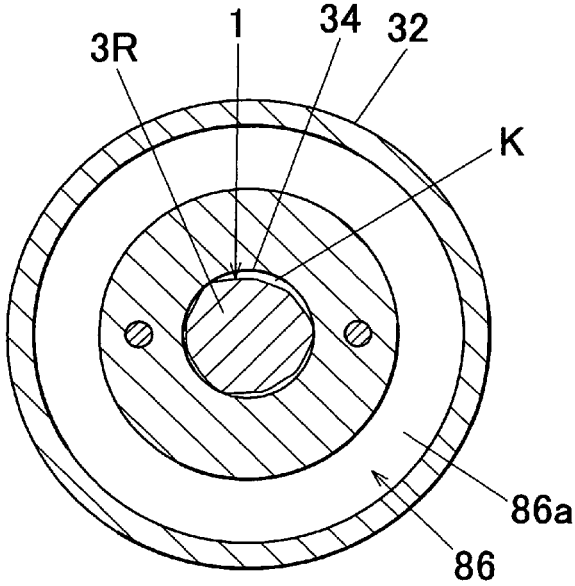
FIG. 11 is an enlarged cross-sectional view taken along the X-X in FIG. 10.

The cross-sectional shape of this raw material 1 is round (approximately round). However, as shown in FIG. 11, when the section of the raw material 1 observed in an enlarged manner, the cross-sectional shape of the raw material 1 is a polygonal shape of a hexagonal shape or more. Therefore, the circularity of the cross-section of this raw material 1 is poor as compared with the raw material made of a round bar-shaped extruded material.

The upsetting apparatus 1C of this third embodiment is equipped with three heating means 81, 82 and 83, three cooling means 85, 86 and 87, one or a plurality of lubricant applying means 91 and 92 (two in this embodiment), in addition to all the structure elements of the upsetting apparatus 1A of the first embodiment.

Moreover, as shown in FIG. 11, the insertion hole 34 of the second guide 32 is round in shape. The circularity of this insertion hole 34 is higher than the circularity of the cross-section of the raw material 1. Furthermore, the diameter of each insertion hole 34 is set to be the same or slightly larger than the maximum diameter of the raw material 1. Therefore, as shown in FIG. 11, in the state where the raw material 1 is inserted in the insertion hole 34, a slight gap K is generated inevitably between the surface of the raw material 1 and the peripheral surface of the insertion hole 34. Furthermore, for the same reason, between the surface of the raw material 1 and the peripheral surface of the insertion hole 34 of the first right guide 31, a slight gap K is generated, and also a slight gap K is generated between the surface of the raw material 1 and the peripheral surface of the insertion hole 44 of the third guide 41.

Three heating means 81, 82 and 83 are the same in structure. The first heating means 81 among these three heating means 81, 82 and 83 is for partially heating the portion 11*x* of the raw material 1 corresponding to the front end portion 31*x* of the first right guide 31 at the right side portion 3R of the raw material 1. Furthermore, the second heating means 82 is for partially heating the portion 12*x* of the raw material 1 corresponding to the front end portion 32*x* of the second right guide 32 at the right side portion 3R of the raw material 1. Moreover, the third heating means 83 is for partially heating the portion 13*x* of the raw material 1 corresponding to the front end portion 41*x* of the left guide 41 at the left side portion 3L of the raw material 1.

The first heating means 81 is a first induction-heating means having a first induction-heating coil 81*a* and a power-supply portion (not shown) for supplying AC current (AC voltage) to the coil 81*a*. The surface of the coil 31*a* is covered by the insulating layer (not shown) consisting of an insulating tape, etc. Furthermore, this coil 31*a* is embedded in the front end portion 31*x* of the first right guide 31 so as to surround the insertion hole 34.

The first right guide 31 is made of a hard non-conductive material having heat resistance, such as, e.g., ceramics, or made of a hard conductive material (e.g., heat-resistant metal material) having heat resistance, such as, e.g., a steel material.

In this first induction-heating means 81, it is configured such that the portion 11*x* of the raw material 1 corresponding to the front end portion 31*x* of the first right guide 31 at the right side portion 3R is partially induction-heated by the coil 81*a* when a current (voltage) of a prescribed frequency (e.g., high frequency or low frequency) is supplied to the coil 81*a* by the power-supply portion. Furthermore, this first induction-heating means 81 is configured such that the portion 11*x* of the raw material 1 can be heated into a half-molten state by raising the induction-heating temperature of the portion 11*x* by increasing, e.g., the current supplying amount to the coil 81*a*.

The second heating means 82 is a second induction-heating means having a second induction-heating coil 82*a* and a power-supply portion 82*b* for supplying AC current (AC voltage) to the coil 82*a*. The surface of the coil 82*a* is covered with an insulating layer (not shown) consisting of, e.g., an insulating tape. Furthermore, this coil 82*a* is embedded in the front end portion 32*x* of the second right guide 32 so as to surround the insertion hole 34.

The second right guide 32 is made of a hard non-conductive material having heat resistance, such as, e.g., ceramics, or made of a hard conductive material (e.g., heat-resistant metal material) having heat resistance, such as, e.g., a steel material.

In this second induction-heating means 82, it is configured such that the portion 12*x* of the raw material 1 corresponding to the front end portion 32*x* of the second right guide 32 at the right side portion 3R is partially induction-heated by the coil 82*a* when a current (voltage) of a prescribed frequency (e.g., high frequency or low frequency) is supplied to the coil 82*a* by the power-supply portion 82*b*. Furthermore, this second induction-heating means 82 is configured such that the portion 12*x* of the raw material 1 can be heated into a half-molten state by raising the induction-heating temperature of the portion 12*x* by increasing, e.g., the current supplying amount to the coil 82*a*.

The third heating means 83 is a third induction-heating means having a third induction-heating coil 83*a* and a power-supply portion 83*b* for supplying AC current (AC voltage) to the coil 83*a*. The surface of the coil 83*a* is covered with an insulating layer (not shown) consisting of, e.g., an insulating tape. Furthermore, this coil 83*a* is embedded in the front end portion 41*x* of the left guide 41 so as to surround the insertion hole 44.

The left guide 41 is made of a hard non-conductive material having heat resistance, such as, e.g., ceramics, or made of a hard conductive material (e.g., heat-resistant metal material) having heat resistance, such as, e.g., a steel material.

In this third induction-heating means 83, it is configured such that the portion 13*x* of the raw material 1 corresponding to the front end portion 41*x* of the left guide 41 at the left side portion 3L is partially induction-heated by the coil 83*a* when a current (voltage) of a prescribed frequency (e.g., high frequency or low frequency) is supplied to the coil 83*a* by the power-supply portion 83*b*. Furthermore, this third induction-heating means 83 is configured such that the portion 13*x* of the raw material 1 can be heated into a half-molten state by raising the induction-heating temperature of the portion 13*x* by increasing, e.g., the current supplying amount to the coil 83*a*.

Three cooling means 85, 86 and 87 are the same in structure. Among these three cooling means 85, 86 and 87, the first cooling means 85 is for partially cooling the portion 11*y* of the raw material 1 corresponding to the portion of the first right guide 31 located behind the front end portion 31*x* of the first right guide 31 at the right side portion 3R of the raw material 1. The second cooling means 86 is for partially cooling the portion 12*y* of the raw material 1 corresponding to the portion of the second right guide 32 located behind the front end portion 32*x* of the second right guide 32 at the right side portion 3R of the raw material 1. Moreover, the third cooling means 87 is for partially cooling the portion 13*y* of the raw material 1 corresponding to the portion of the left guide 41 located behind the front end portion 41*x* of the left guide 41 at the left side portion 3L of the raw material 1.

The first cooling means 85 has a cooling fluid passage 85*a* formed in the region covering from the front end portion 31*x* of the first right guide 31 to the rear end portion. The first cooling means 85 is configured to partially cooling the portion 11*y* of the raw material 1 corresponding to the portion of the first right guide 31 located behind the front end portion 31*x* of the first right guide 31 at the right side portion 3R of the raw material 1 by circulating cooling fluid, such as, e.g., cooling water, in the cooling fluid passage 85*a*.

The second cooling means 86 has a cooling fluid passage 86*a* formed in the rear end portion of the second right guide 32. This second cooling means 86 is configured to partially cooling the portion 12*y* of the raw material 1 corresponding to the portion of the second right guide 32 located behind the front end portion 32*x* of the second right guide 32 at the right side portion 3R of the raw material 1 by circulating cooling fluid, such as, e.g., cooling water, in the cooling fluid passage 86*a*.

The third cooling means 87 has a cooling fluid passage 87*a* formed in the rear end portion of the left guide 41. This third cooling means 87 is configured to partially cooling the portion 13*y* of the raw material 1 corresponding to the portion of the left guide 41 located behind the front end portion 41*x* of the left guide 41 at the left side portion 3L of the raw material 1 by circulating cooling fluid, such as, e.g., cooling water, in the cooling fluid passage 87*a*.

The two lubricant applying means 91 and 92 are the same in structure. The first lubricant applying means 91 out of these two lubricant applying means 91 and 92 is for making lubricant (not shown) adhere to the peripheral surfaces of the insertion holes 34 and 34 of the first right guide 31 and the second right guide 32. The second lubricant applying means 92 is for making lubricant adhere to the peripheral surface of the insertion hole 44 of the left guide 41.

The lubricant is for reducing the frictional resistance between the surface of the raw material 1 and the peripheral surfaces of the insertion holes 34, 34 and 44 of each guide 31, 32 and 41. As this lubricant, for example, fluid lubrication, such as, e.g., oily lubricant, can be used. More specifically, "Oildag" (trade name) made by Acheson (Japan) Limited and "Dafni dina draw" (trade name) made by Idemitsu Kosan Co., Ltd., or the like, can be used.

The first lubricant applying means 91 has a nozzle 91*a* for spraying lubricant and a lubricant supplying portion 91*b* for supplying lubricant to the nozzle 91*a*. It is configured to make the lubricant spay and adhere to the peripheral surface of the insertion hole 34 of the first right guide 31 and the peripheral surface of the insertion hole 34 of the second right guide 32.

In the present invention, in addition to this, the first lubricant applying means 91 can be a means for making lubricant spray and adhere to the surface of the right side portion 3R of the raw material 1, or a means for making lubricant spray and adhere to both the peripheral surfaces of the insertion hole 34 and the surface of the right side portion 3R of the raw material 1.

The second lubricant applying means 92 has a nozzle 92*a* for spraying lubricant and a lubricant supplying portion 92*b* for supplying lubricant to the nozzle 92*a*. It is configured to make the lubricant spay and adhere to the peripheral surface of the insertion hole 44 of the left guide 41.

In the present invention, in addition to this, the second lubricant applying means 92 can be a means for making lubricant spray and adhere to the surface of the left side portion 3L of the raw material 1, or a means for making lubricant spray and adhere to both the peripheral surfaces of the insertion hole 44 and the surface of the left side portion 3L of the raw material 1.

Next, the upsetting method using the upsetting apparatus 1C of this third embodiment will be explained below.

Initially, lubricant is made to adhere to the peripheral surfaces of the insertion holes 34, 34 and 44 of the guides 31, 32 and 41 by the corresponding lubricant applying means 91. Lubricant can also be made to adhere to the surfaces of the right side portion 3R and the left side portion 3L of the raw material 1.

Subsequently, as shown in FIG. 10, the axial intermediate portion 2 of the raw material 1 is inserted and held in the raw material fixing insertion hole 21 of the fixed die 20. Thereby, the raw material 1 is secured so as not to move with respect to the axial direction.

Furthermore, the right side portion 3R of the raw material 1 is inserted and held in each of the insertion holes 34 and 34 of the first right guide 31 and the second right guide 32. In this state, as shown in FIG. 11, in the gap K between the surface of the right side portion 3R of the raw material 1 and the peripheral surface of each insertion hole 34 and 34, the lubricant (not shown) adhering to the peripheral surface of the insertion holes 34 and 34 is introduced by capillarity action, etc., and temporarily retained.

Furthermore, the left side portion 3L of the raw material 1 is inserted and held in the insertion hole 44 of the left guide 41. In this state, in the same manner as mentioned above, the lubricant adhering to the peripheral surface of the insertion hole 44 is temporarily retained in the gap between the surface of the left side portion 3L of the raw material 1 and the peripheral surface of the insertion hole 44.

Furthermore, the portion 11*x* of the raw material 1 corresponding to the front end portion 31*x* of the first right guide 31 at the right side portion 3R of the raw material 1 is partially induction-heated into a prescribed temperature by supplying current of a prescribed frequency to the coil 81*a* of the first induction-heating means 81 by the power-supply portion. Thereby, the deformation resistance at the portion 11*x* of the raw material 1 is reduced partially.

This heating temperature is not specifically limited so long as it is a temperature which causes a deterioration of the deformation resistance of the portion 11*x* of the raw material 1. However, the concrete preferable heating temperature can be exemplified as follows.

For example, in the case where the raw material 1 is made of aluminum or aluminum alloy, 200 to 580° C. (more preferably 350 to 540° C.) can be exemplified as a preferable heating temperature range. Furthermore, in the case where the portion 11*x* of the raw material 1 is partially heated into a half-molten state, 580 to 625° C. (more preferably 600 to 615° C.) can be exemplified as a preferable heating temperature range. However, the present invention is not limited to the aforementioned heating temperature range.

Furthermore, the portion 11*y* of the raw material 1 corresponding to the portion of the first right guide 31 located behind the front end portion 31*x* of the first right guide 31 at the right side portion 3R of the raw material 1 can be partially cooled by circulating cooling fluid, such as, e.g., cooling water of a normal temperature, in the cooling fluid passage 85*a* of the first cooling means 85. This prevents deterioration of the deformation resistance at the portion 11*y* of the raw material 1.

As a preferable cooling temperature range in this case, for example, 30 to 80° C. (more preferably 40 to 60° C.) can be exemplified. In the present invention, however, the cooling temperature is not limited to the aforementioned cooling temperature.

On the other hand, current is not supplied to the coil 82*a* of the second induction-heating means 82, therefore the portion 12*x* of the raw material 1 corresponding to the front end portion 32*x* of the second right guide 32 at the right side portion 3R of the raw material 1 will not be heated. Therefore, the deformation resistance of the portion 12*x* of the raw material 1 will not be reduced.

Furthermore, the portion 12*y* of the raw material 1 corresponding to the portion of the second right guide 32 located behind the front end portion 32*x* of the second right guide 32 at the right side portion 3R of the raw material 1 is partially cooled by circulating cooling fluid, such as, e.g., cooling water of a normal temperature in the cooling fluid passage 86*a* of the second cooling means 86. Thereby, deterioration of the deformation resistance of the portion 12*y* of the raw material 1 can be restrained.

The preferable cooling temperature range in this case is the same as the aforementioned range.

Furthermore, the portion 13*x* of the raw material 1 corresponding to the front end portion 41*x* of the left guide 41 at the left side portion 3L of the raw material 1 is partially induction-heated into a prescribed temperature by supplying current of a prescribed frequency to the coil 83*a* of the third induction-heating means 83 by the power-supply portion 83*b*. Thereby, the portion 13*x* of the raw material 1 is partially reduced in deformation resistance.

Although this heating temperature is not specifically limited so long as it causes deterioration of the deformation resistance of the portion 13*x* of the raw material 1, the aforementioned range can be exemplified as the preferable heating temperature range.

Furthermore, the portion 13*y* of the raw material 1 corresponding to the portion of the left guide 41 located behind the front end portion 41*x* of the left guide 41 at the left side portion 3L of the raw material 1 is partially cooled by circulating cooling fluid, such as, e.g., cooling water of a normal temperature in the cooling fluid passage 87*a* of the third cooling means 87. This restrains deterioration of the deformation resistance of the portion 13*y* of the raw material.

The preferable cooling temperature range in this case is the same as the aforementioned range.

Next, while maintaining this state, in the same procedures as in the upsetting method shown as the first embodiment, the first exposed portion 4 of the raw material 1 and the third exposed portion 6 thereof are simultaneously expanded in diameter in a non-restrained manner.

Figure 12:
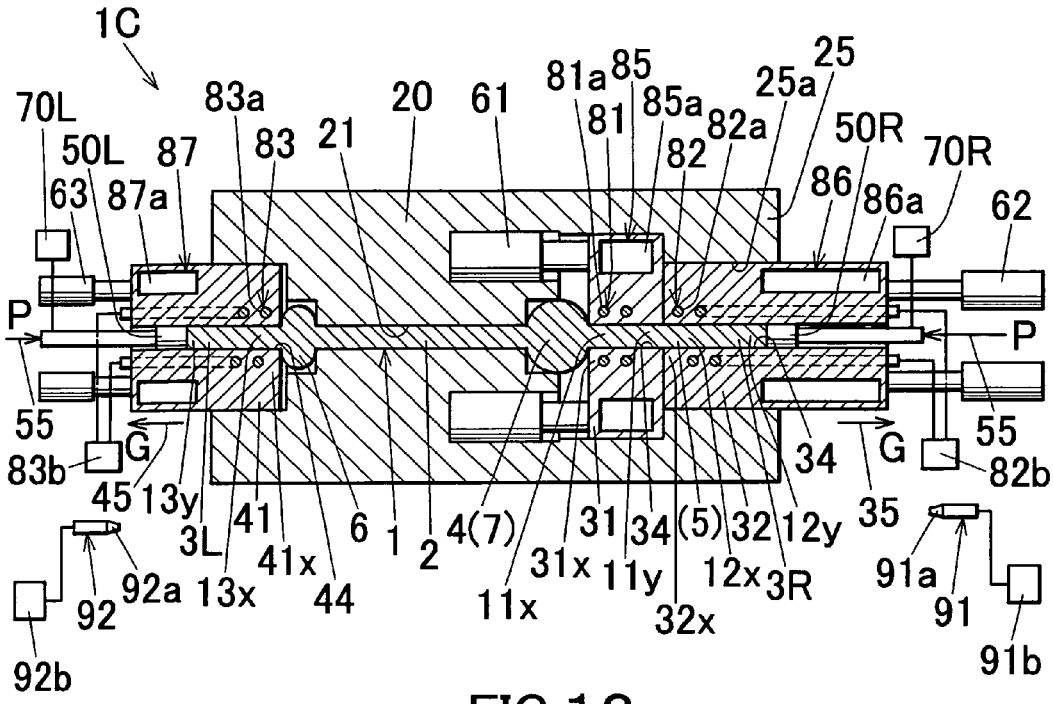
FIG. 12 is a vertical cross-sectional view of the principal part of the upsetting apparatus showing the state the prescribed portions of the raw material are being expanded in diameter with the upsetting apparatus.
Figure 13:
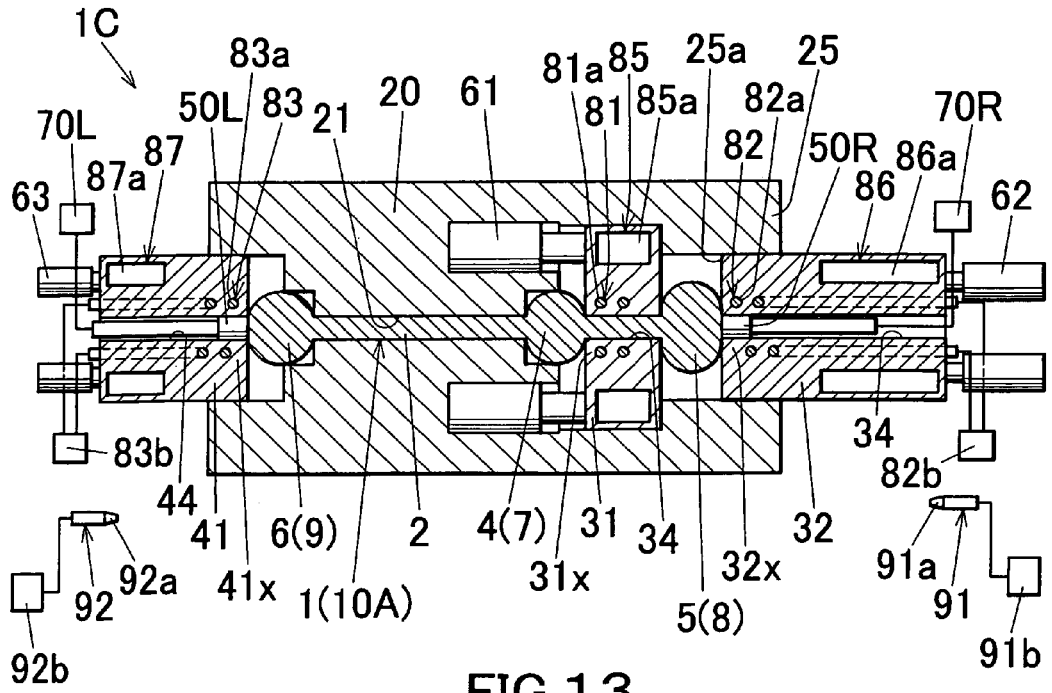
FIG. 13 is a vertical cross-sectional view of the principal part of the upsetting apparatus showing the state after expanding the prescribed portions of the raw material with the upsetting apparatus.

As shown in FIG. 12, the first exposed portion 4 of the raw material 1 is expanded in diameter into a designed shape, i.e., an approximately spherical shape (or approximately spindle shape), the portion 12*x* of the raw material 1 corresponding to the front end portion 32*x* of the second right guide 32 at the right side portion 3R of the raw material 1 is partially induction-heated into a prescribed temperature by supplying current of prescribed frequency to the coil 82*a* of the second induction-heating means 82 by the power-supply portion 82*b*. Thus, the portion 12*x* of the raw material 1 is partially decreased in deformation resistance.

Although this heating temperature is not specifically limited so long as it causes deterioration of the deformation resistance of the portion 12*x* of the raw material 1, the aforementioned range can be exemplified as the preferable heating temperature range.

Furthermore, the portion 12*y* of the raw material 1 corresponding to the portion of the second right guide 32 located behind the front end portion 32*x* of the second right guide 32 at the right side portion 3R of the raw material 1 is partially cooled by circulating cooling fluid, such as, e.g., cooling water in the cooling fluid passage 86*a* of the second cooling means 86. This restrains deterioration of the deformation resistance of the portion 12*y* of the raw material.

Next, while maintaining this state, in the same procedures as in the upsetting method shown as the first embodiment, the second exposed portion 5 of the raw material 1 and the third exposed portion 6 thereof are simultaneously expanded in diameter in a non-restrained manner.

The upsetting of the raw material 1 is completed at three portions through the above procedure.

Thereafter, the raw material 1 is removed from the insertion holes 21 of the fixed die 20 and the insertion holes 34, 34 and 44 of the guides 31, 32 and 41. Thus, a desired upsetting manufactured product 10A shown in FIG. 5 can be obtained.

Thus, the upsetting method of the third embodiment has the following advantage in addition to the advantages of the upsetting method of the first embodiment.

That is, since the raw material 1 is made of a round bar-shaped rolled material, the raw material 1 can be obtained or manufactured at low cost. This enables reduction of working cost.

Furthermore, since the raw material is made of a cast rolled material, the raw material 1 can be obtained or manufactured at lower cost. This enables further reduction of working cost. Furthermore, since the raw material 1 is made of a continuously cast rolled material manufactured by the Properzi method, the raw material 1 can be obtained or manufactured at still lower cost. This in turn can further reduce the working cost.

Therefore, according to the upsetting method of the fourth embodiment, an upsetting manufactured product 10A can be provided at low cost.

Furthermore, this raw material 1 is poor in circularity as compared with the round bar-shaped raw material made of an extruded material. Therefore, when this raw material 1 is inserted to the insertion holes 34, 34 and 44 of each of the guides 31, 32 and 41, as mentioned above, a gap K will be inevitably generated between the surface of the raw material 1 and the peripheral surface of the insertion holes 34, 34 and 44 (see FIG. 11). Therefore, the contact-surface area therebetween is small. Therefore, the frictional-resistance force caused when the raw material 1 is axially slidably moved in the insertion hole 34 of each guide 31, 32 and 41 at the time of working is small, which can reduce the molding pressure. Therefore, as the punch driving apparatus 70R and 70L for moving each punch 50R and 50L, a small one can be used, resulting in a saved installation space for the upsetting apparatus 1C.

Furthermore, since the molding pressure can be reduced, there are the following advantages. That is, if molding pressure is large, the end portion of the raw material 1 may be sometimes crushed in the insertion hole 34 and 44 of the guides 32 and 41 by the pressing force from each punch 50R and 50L. In this case, some material of the raw material 1 will be introduced into the gap between the peripheral surface of each punch 50R and 50L and the peripheral surface of the insertion hole 34 and 44. This results in an increased molding pressure, which in turn makes it impossible for each punch 50R and 50L to move in the pressing direction in the insertion hole 34 and 44, resulting in unworkable. Then, reducing the molding pressure can prevent occurrence of such problem, which in turn enables execution of the upsetting of the raw material 1 over a long region.

The adhering of the lubricant on the peripheral surface of the insertion hole 34, 34 and 44 of each guide 31, 32 and 41 brings the following advantages. That is, since the gap K is generated between the surface of the raw material 1 and the peripheral surface of the insertion hole 34, 34 and 44, the lubricant is introduced into and temporarily retained in the gap K. This enhances the applying of the lubricant to the peripheral surface of the insertion hole 34, 34 and 44 and the surface of the raw material 1. That is, in accordance with the axial slide movement of the raw material 1 in the insertion hole 34, 34 and 44 at the time of working, the lubricant retained in the gap K is applied to the peripheral surface of the insertion hole 34, 34 and 44 and the surface of the raw material 1. This assuredly can reduce the frictional-resistance force between the peripheral surface of the insertion hole 34, 34 and 44 and the surface of the raw material 1, namely, the molding pressure can be reduced assuredly.

Furthermore, the portion 11*x*, 12*x* and 13*x* of the raw material 1 partially reduces in deformation resistance by partially induction-heating the portion 11*x*, 12*x* and 13*x* of the raw material 1 corresponding to the front end portion 31*x*, 32*x* and 41*x* of each guide 31, 32 and 41. This enables further reduction of molding pressure.

On the other hand, since the portion 11*y*, 12*y* and 13*y* of the raw material 1 corresponding to the portion of each guide 31, 32 and 41 located behind the front end portion 31*x*, 32*x* and 41*x* of each guide 31, 32 and 41 is not heated, deformation resistance is not reduced. This prevents an increased molding pressure which will be caused by expansion of the raw material 1 in the insertion hole 34, 34 and 44 of each guide 31, 32 and 41 by the pressing force by the punch 50R and 50L.

Furthermore, the prescribed portion 11*x*, 12*x* and 13*x* of the raw material 1 can be heated assuredly and very efficiently by partially induction-heating the prescribed portions 11*x*, 12*x* and 13*x* of the raw material 1 by the induction-heating means 85, 86 and 87.

Furthermore, in the present invention, the prescribed portions 11*x*, 12*x* and 13*x* of the raw material 1 can be partially heated into a half-molten state by raising the heating temperature. In this case, the molding pressure can be reduced considerably. The upsetting in this case can be classified under a category of Thixomolding.

Furthermore, since the portion 11*y*, 12*y* ad 13*y* of the raw material 1 corresponding to the portion of each guide 31, 32 and 41 located behind the front end portion 31*x*, 32*x* and 41*x* of each guide 31, 32 and 41 is partially cooled, the heating of the portion 11*y*, 12*y* and 13*y* of the raw material 1 can be prevented assuredly. Consequently, deterioration of the deformation resistance at the portion 11*y*, 12*y* and 13*y* of the raw material 1 can be restrained assuredly.

In the third embodiment, the portion 11*x*, 12*x*, and 13*x* of the raw material 1 corresponding to the tip end portion 31*x*, 32*x* and 41*x* of each guide 31, 32 and 41 is partially induction-heated by the induction-heating means 85, 86 and 87. In the present invention, however, in place of the above, for example, the tip end portion 31*x*, 32*x* and 41*x* of each guide 31, 32 and 41 can be partially introduction-heated by the induction-heating means 85, 86 and 87 to thereby partially heat the portion 11$x$, 12$x$ and 13$x$ of the raw material 1 corresponding to the tip end portion 31$x$, 32$x$ and 41$x$ of each guide 31, 32 and 41 by the heat of the tip end portion 31$x$, 32$x$ and 41$x$ of each guide 31, 32 and 41. That is, the heat of the tip end portion 31$x$, 32$x$ and 41$x$ of each guide 31, 32 and 41 is conducted to the portion 11$x$, 12$x$ and 13$x$ of the raw material 1 to thereby partially heat the portion 11$x$, 12$x$ and 13$x$ of the raw material 1. In this case, the portion 11$x$, 12$x$ and 13$x$ of the raw material 1 can be heated assuredly and efficiently. Moreover, in this case, each guide 31, 32 and 41 is preferably made of conductive material (e.g., heat-resistant metal material) having heat resistance, such as, e.g., steel material.

FIGS. 14 to 17 are schematic views for explaining an upsetting method using an upsetting apparatus according to a fourth embodiment of the present invention.

Figure 14:
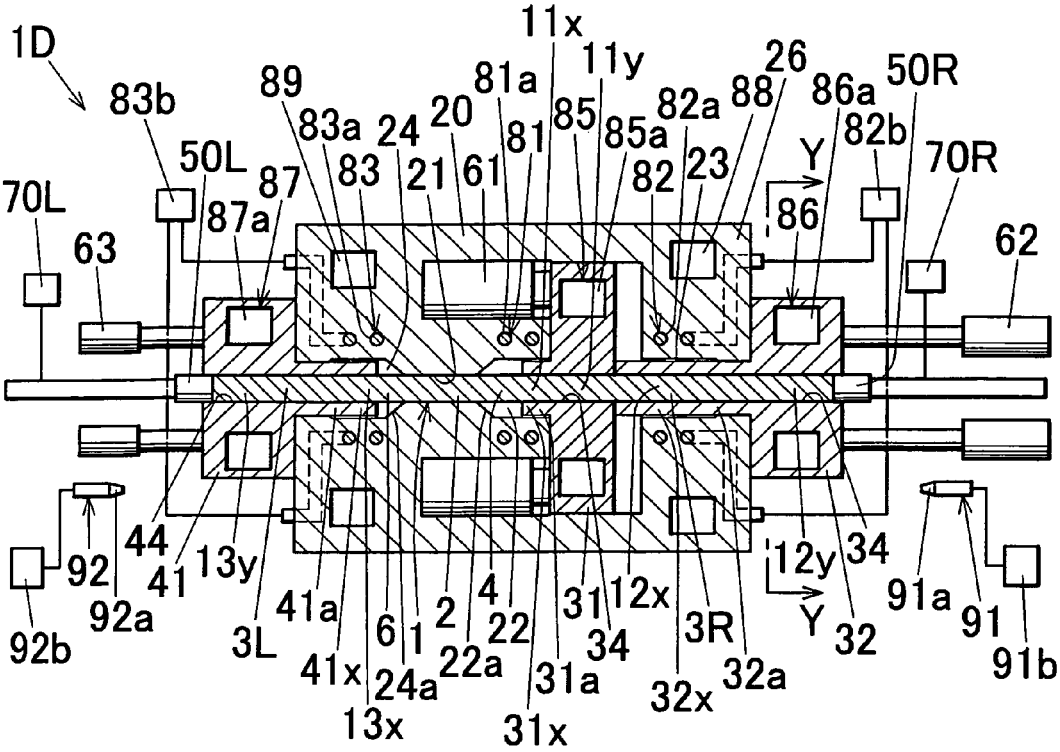
FIG. 14 is a vertical cross-sectional view of the principal part of the upsetting apparatus showing the state before expanding the prescribed portions of the raw material with the upsetting apparatus according to a fourth embodiment of the present invention.

In FIG. 14, "1D" denotes an upsetting apparatus according to the fourth embodiment. In FIG. 14, the same reference numeral/mark is allotted to the same structural element as the structural element of the upsetting apparatus 1B according to the second embodiment shown in FIGS. 6 to 9. Hereafter, the structure of the upsetting apparatus 1D of this fourth embodiment will be explained focusing on the differences between this apparatus and the upsetting apparatuses 1B and 1C of the second and third embodiments.

Figure 9:
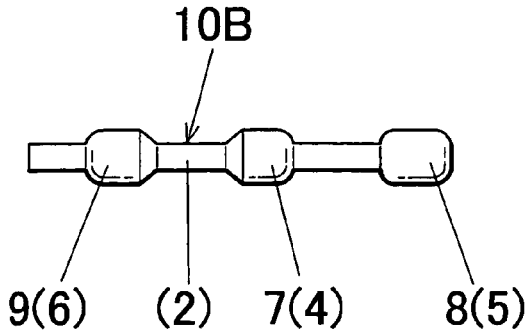
FIG. 9 is a plan view of an upsetting manufactured product obtained using the upsetting apparatus.

The upsetting manufactured product to be manufactured by the upsetting apparatus 1D of the fourth embodiment is the same as the upsetting manufactured product 10B shown in FIG. 9.

In the fourth embodiment, a raw material 1 is a round bar-shaped material, in detail, a columnar bar-shaped material like the third embodiment. In detail, it is a continuously cast rolled material manufactured by a known Properzi method.

Figure 15:
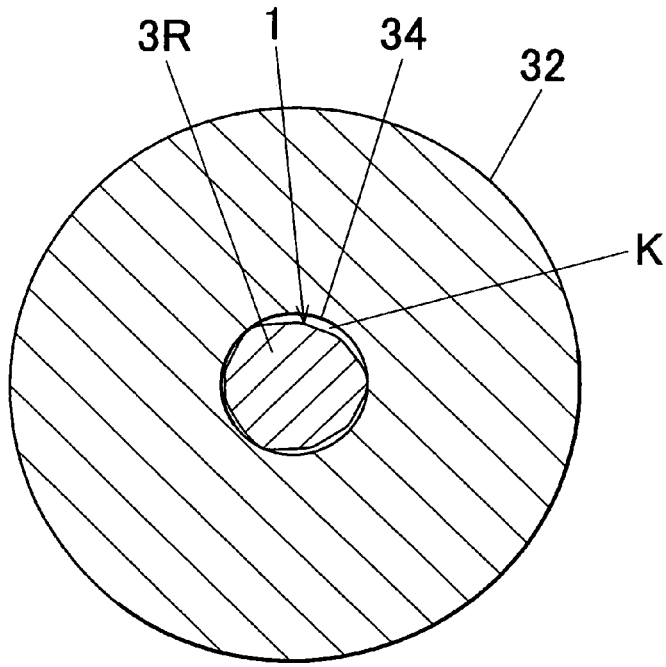
FIG. 15 is an enlarged cross-sectional view taken along the line Y-Y in FIG. 14.

The cross-sectional shape of this raw material 1 is round (approximately round). However, as shown in FIG. 15, when the cross-section of the raw material 1 is observed in an enlarged manner, the cross-sectional shape of the raw material 1 is a polygonal shape of a hexagonal shape or more. Therefore, the circularity of the cross-section of this raw material 1 is poor as compared with the raw material made of a round bar-shaped extruded material.

The upsetting apparatus 1D of this fourth embodiment is equipped with three heating means 81, 82 and 83, three cooling means 85, 86 and 87, one or a plurality of lubricant applying means 91 and 92 (two in this embodiment), in addition to all the structure elements of the upsetting apparatus 1B of the second embodiment.

Moreover, as shown in FIG. 15, the insertion hole 34 of the second right guide 32 is round in shape. The circularity of this insertion hole 34 is higher than the circularity of the cross-section of the raw material 1. Furthermore, the diameter of each insertion hole 34 is set to be the same or slightly larger than the maximum diameter of the raw material 1. Therefore, as shown in FIG. 15, in the state where the raw material 1 is inserted in the insertion hole 34, a slight gap K is generated inevitably between the surface of the raw material 1 and the peripheral surface of the insertion hole 34. Furthermore, for the same reason, between the surface of the raw material 1 and the peripheral surface of the insertion hole 34 of the first right guide 31, a slight gap K is generated, and a slight gap K is generated between the surface of the raw material 1 and the peripheral surface of the insertion hole 44 of the left guide 41.

Three heating means 81, 82 and 83 are the same in structure. The first heating means 81 among these three heating means 81, 82 and 83 is for partially heating the portion 11$x$ of the raw material 1 corresponding to the front end portion 31$x$ of the first right guide 31 at the right side portion 3R of the raw material 1. Furthermore, the second heating means 82 is for partially heating the portion 12$x$ of the raw material 1 corresponding to the front end portion 32$x$ of the second right guide 32 at the right side portion 3R of the raw material 1. Moreover, the third heating means 83 is for partially heating the portion 13$x$ of the raw material 1 corresponding to the front end portion 41$x$ of the left guide 41 at the left side portion 3L of the raw material 1.

The first heating means 81 is a first induction-heating means having a first induction-heating coil 81$a$ and a power-supply portion (not shown) for supplying AC current (AC voltage) to the coil 81$a$. The surface of the coil 81$a$ is covered by the insulating layer (not shown) consisting of an insulating tape, etc. Furthermore, this coil 81$a$ is embedded in the fixed die 20 so as to surround the first forming dented portion 22.

The first right guide 31 is made of a hard conductive material having heat resistance, such as, e.g., steel material. In the same manner, the fixed die 20 is made of, e.g., a hard conductive material (e.g., heat-resistant metal material) having heat resistance, such as, e.g., steel material.

In this first induction-heating means 81, it is configured such that when a current (voltage) of a prescribed frequency (e.g., high frequency or low frequency) is supplied to the coil 81$a$ by the power-supply portion, the front end portion 31$x$ of the first right guide 31 (in detail, the front end portion 31$x$ of the male die portion 31$a$) is partially heated by the coil 81$a$, to thereby partially heat the portion 11$x$ of the raw material 1 corresponding to the front end portion 31$x$ of the first right guide 31 at the right side portion 3R by the heat of the front end portion 31$x$ of the first right guide 31. That is, it is configured such that the heat of the front end portion 31$x$ of the first right guide 31 is conducted to the portion 11$x$ of the raw material 1 to thereby partially heat the portion 11$x$ of the raw material 1. Furthermore, this first induction-heating means 81 is configured such that the portion 11$x$ of the raw material 1 can be heated into a half-molten state by raising the heating temperature of the portion 11$x$ by increasing, e.g., the current supplying amount to the coil 81$a$.

The second heating means 82 is a second induction-heating means having a second induction-heating coil 82$a$ and a power-supply portion 82$b$ for supplying AC current (AC voltage) to the coil 82$a$. The surface of the coil 82$a$ is covered with an insulating layer (not shown) consisting of, e.g., an insulating tape. Furthermore, this coil 82$a$ is embedded in the forming die portion 26 of the fixed die 20 so as to surround the second molding dented portion 23.

The second right guide 32 is made of a hard conductive material having heat resistance, such as, e.g., steel material (e.g., heat-resistant metal material).

In this second induction-heating means 82, it is configured such that when a current (voltage) of a prescribed frequency (e.g., high frequency or low frequency) is supplied to the coil 82$a$ by the power-supply portion 82$b$, the front end portion 32$x$ of the second right guide 32 (in detail, the front end portion 32$x$ of the male die portion 32$a$) is partially induction-heated, to thereby partially heat the portion 12$x$ of the raw material 1 corresponding to the front end portion 32$x$ of the second right guide 32 at the right side portion 3R by the heat of the front end portion 32$x$ of the second right guide 32. That is, it is configured such that the heat of the front end portion 32$x$ of the second right guide 32 is conducted to the portion 12$x$ of the raw material 1 to thereby partially heat the portion 12$x$ of the raw material 1. Furthermore, this second induction-heating means 82 is configured such that the portion 12*x* of the raw material 1 can be heated into a half-molten state by raising the heating temperature of the portion 12*x* of the raw material 1 by increasing, e.g., the current supplying amount to the coil 82*a*.

The third heating means 83 is a third induction-heating means having a third induction-heating coil 83*a* and a power-supply portion 83*b* for supplying AC current (AC voltage) to the coil 83*a*. The surface of the coil 83*a* is covered with an insulating layer (not shown) consisting of, e.g., an insulating tape. Furthermore, this coil 83*a* is embedded in the fixed die 20 so as to surround the third molding dented portion 24.

The left guide 41 is made of a hard conductive material having heat resistance, such as, e.g., steel material (e.g., heat-resistant metal material).

In this third induction-heating means 83, it is configured such that when a current (voltage) of a prescribed frequency (e.g., high frequency or low frequency) is supplied to the coil 83*a* by the power-supply portion 83*b*, the front end portion 41*x* of the left guide 41 (in detail, the front end portion 41*x* of the male die portion 41*a*) is partially heated by the coil 83*a*, to thereby partially heat the portion 13*x* of the raw material 1 corresponding to the front end portion 41*x* of the left guide 41 at the left side portion 3L by the heat of the front end portion 41*x* of the left guide 41. That is, it is configured such that the heat of the front end portion 41*x* of the left guide 41 is conducted to the portion 13*x* of the raw material 1 to thereby partially heat the portion 13*x* of the raw material 1. Furthermore, this third induction-heating means 83 is configured such that the portion 13*x* of the raw material 1 can be heated into a half-molten state by raising the heating temperature of the portion 13*x* by increasing, e.g., the current supplying amount to the coil 83*a*.

Three cooling means 85, 86 and 87 are the same in structure. Among these three cooling means 85, 86 and 87, the first cooling means 85 is for partially cooling the portion 11*y* of the raw material 1 corresponding to the portion of the first right guide 31 located behind the front end portion 31*x* of the first right guide 31 at the right side portion 3R of the raw material 1. The second cooling means 86 is for partially cooling the portion 12*y* of the raw material 1 corresponding to the portion of the second right guide 32 located behind the front end portion 32*x* of the second right guide 32 at the right side portion 3R of the raw material 1. Moreover, the third cooling means 87 is for partially cooling the portion 13*y* of the raw material 1 corresponding to the portion of the left guide 41 located behind the front end portion 41*x* of the left guide 41 at the left side portion 3L of the raw material 1.

The first cooling means 85 has a cooling fluid passage 85*a* formed in the rear end portion of the first right guide 31. The first cooling means 85 is configured to partially cool the portion 11*y* of the raw material 1 corresponding to the portion of the first right guide 31 located behind the front end portion 31*x* of the first right guide 31 at the right side portion 3R of the raw material 1 by circulating cooling fluid, such as, e.g., cooling water, in the cooling fluid passage 85*a*.

The second cooling means 86 has a cooling fluid passage 86*a* formed in the rear end portion of the second right guide 32. This second cooling means 86 is configured to partially cool the portion 12*y* of the raw material 1 corresponding to the portion of the second right guide 32 located behind the front end portion 32*x* of the second right guide 32 at the right side portion 3R of the raw material 1 by circulating cooling fluid, such as, e.g., cooling water, in the cooling fluid passage 86*a*.

The third cooling means 87 has a cooling fluid passage 87*a* formed in the rear end portion of the left guide 41. This third cooling means 87 is configured to partially cool the portion 13*y* of the raw material 1 corresponding to the portion of the left guide 41 located behind the front end portion 41*x* of the left guide 41 at the left side portion 3L of the raw material 1 by circulating cooling fluid, such as, e.g., cooling water, in the cooling fluid passage 87*a*.

"88" denotes a cooling fluid passage formed in the molding die portion 26 of the fixed die 20. This cooling fluid passage 88 is for restraining the heat produced by the coil 82*a* of the first induction-heating means 82 from conducting to other portions of the fixed die 20 by circulating cooling fluid in the passage 88. "89" is a cooling fluid passage formed in the left end portion of the fixed die 20. This cooling fluid passage 89 is for restraining the heat produced by the coil 83*a* of the third induction-heating means 83 from conducting to other portions of the fixed die 20 by circulating cooling fluid in the passage 89.

The two lubricant applying means 91 and 92 are the same in structure. The first lubricant applying means 91 out of these two lubricant applying means 91 and 92 is for making lubricant (not shown) adhere to the peripheral surfaces of the insertion holes 34 and 34 of the first right guide 31 and the second right guide 32. The second lubricant applying means 92 is for making lubricant adhere to the peripheral surface of the insertion hole 44 of the left guide 41.

The structure of each lubricant applying means 91 and 92 and the usage thereof are the same as the lubricant applying means of the upsetting apparatus 1C of the third embodiment.

Next, the upsetting method using the upsetting apparatus 1D of this fourth embodiment will be explained below.

Initially, lubricant is made to adhere to the peripheral surfaces of the insertion holes 34, 34 and 44 of each of the guides 31, 32 and 41 by the corresponding lubricant applying means 91 and 92. Lubricant can also be made to adhere to the surfaces of the right side portion 3R and the left side portion 3L of the raw material 1.

Subsequently, as shown in FIG. 14, the axial intermediate portion 2 of the raw material 1 is inserted and held in the raw material fixing insertion hole 21 of the fixed die 20.

Furthermore, the right side portion 3R of the raw material 1 is inserted and held in each of the insertion holes 34 and 34 of the first right guide 31 and the second right guide 32 in order. In this state, as shown in FIG. 15, in the gap K between the surface of the right side portion 3R of the raw material 1 and the peripheral surface of each insertion hole 34 and 34, the lubricant (not shown) adhering to the peripheral surface of the insertion holes 34 and 34 is introduced by capillarity action, etc., and temporarily retained.

Furthermore, the left side portion 3L of the raw material 1 is inserted and held in the insertion hole 44 of the left guide 41. In this state, in the same manner as mentioned above, the lubricant adhering to the peripheral surface of the insertion hole 44 is temporarily retained in the gap between the surface of the left side portion 3L of the raw material 1 and the peripheral surface of the insertion hole 44.

Furthermore, the front end portion 31*x* of the first right guide 31 is partially induction-heated by supplying current of a prescribed frequency to the coil 81*a* of the first induction-heating means 81 by the power-supply portion. This partially heats the portion 11*x* of the raw material 1 corresponding to the front end portion 31*x* of the first right guide 31 at the right side portion 3R of the raw material 1 into a prescribed temperature by the heat of the front end portion 31$x$ of the first right guide 31. Thereby, the deformation resistance at the portion 11$x$ of the raw material 1 is reduced partially.

The preferable range of the heating temperature of the portion 11$x$ of the raw material 1 is the same as the preferable range of the heating temperature as described in the third embodiment.

Furthermore, the portion 11$y$ of the raw material 1 corresponding to the portion of the first right guide 31 located behind the front end portion 31$x$ of the first right guide 31 at the right side portion 3R of the raw material 1 is partially cooled by circulating cooling fluid, such as, e.g., cooling water of a normal temperature, in the cooling fluid passage 85*a* of the first cooling means 85. This prevents deterioration of the deformation resistance at the portion 11$y$ of the raw material 1.

The preferable range of the cooling temperature in this case is the same as the preferable range of the cooling temperature as described in the third embodiment.

On the other hand, current is not supplied to the coil 82*a* of the second induction-heating means 82, therefore the portion 12$x$ of the raw material 1 corresponding to the front end portion 32$x$ of the second right guide 32 at the right side portion 3R of the raw material 1 will not be heated. Therefore, the deformation resistance of the portion 12$x$ of the raw material 1 will not be reduced.

Furthermore, the portion 12$y$ of the raw material 1 corresponding to the portion of the second right guide 32 located behind the front end portion 32$x$ of the second right guide 32 at the right side portion 3R of the raw material 1 is partially cooled by circulating cooling fluid, such as, e.g., cooling water of a normal temperature in the cooling fluid passage 86*a* of the second cooling means 86. Thereby, deterioration of the deformation resistance of the portion 12$y$ of the raw material 1 can be restrained.

Furthermore, the front end portion 41$x$ of the left guide 41 is partially induction-heated into a prescribed temperature by supplying current of a prescribed frequency to the coil 83*a* of the third induction-heating means 83 by the power-supply portion 83*b*. Thereby, the portion 13$x$ of the raw material 1 corresponding to the front end portion 41$x$ of the left guide 41 at the left side portion 3L is partially heated into a prescribed temperature by the heat of the front end portion 41$x$ of the left guide 41. Thus, the portion 13$x$ of the raw material 1 is reduced in deformation resistance.

Furthermore, the portion 13$y$ of the raw material 1 corresponding to the portion of the left guide 41 located behind the front end portion 41$x$ of the left guide 41 at the left side portion 3L of the raw material 1 is partially cooled by circulating cooling fluid, such as, e.g., cooling water of a normal temperature in the cooling fluid passage 87*a* of the third cooling means 87. This restrains deterioration of the deformation resistance of the portion 13$y$ of the raw material 1.

Next, while maintaining this state, in the same procedures as in the upsetting method shown as the second embodiment, the first exposed portion 4 of the raw material 1 and the third exposed portion 6 thereof are simultaneously expanded in diameter in the first molding dented portion 22 and the third molding dented portion 24.

Figure 16:
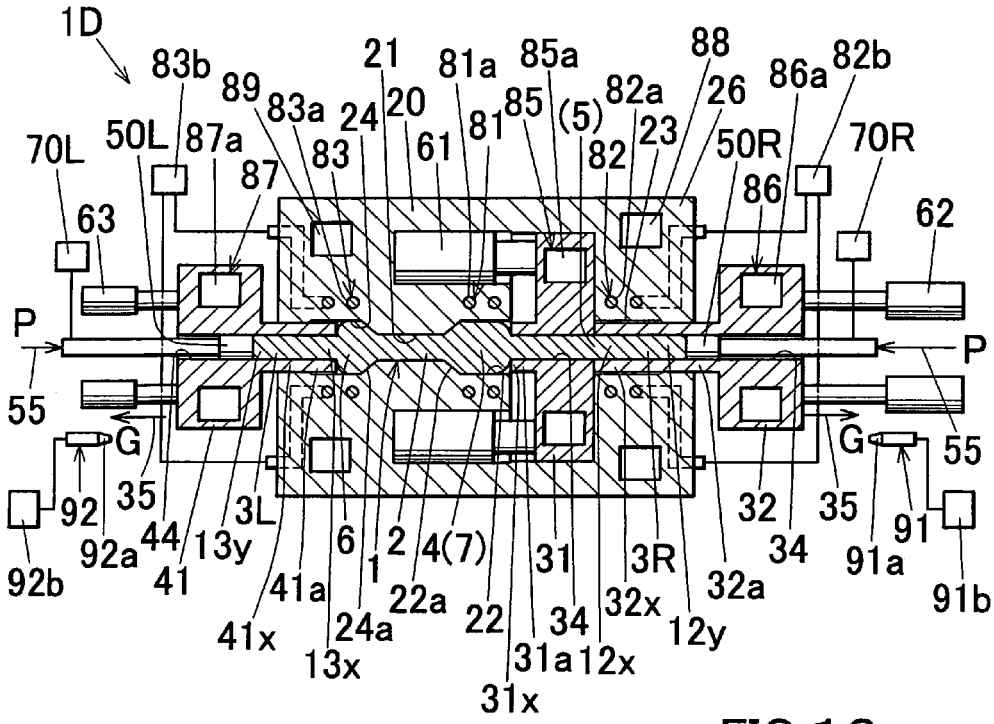
FIG. 16 is a vertical cross-sectional view of the principal part of the upsetting apparatus showing the state in which the prescribed portions of the raw material are being expanded in diameter with the upsetting apparatus.

As shown in FIG. 16, when the first exposed portion 4 of the raw material 1 is expanded in diameter into a designed shape, i.e., an approximately spherical shape in the first molding dented portion 22, the portion 32$x$ of the second right guide 32 is partially induction-heated by supplying current of prescribed frequency to the coil 82*a* of the second induction-heating means 82 by the power-supply portion 82*b* to thereby partially heat the portion 12$x$ of the raw material 1 corresponding to the front end portion 32$x$ of the second right guide 32 at the right side portion 3R of the raw material 1 into a prescribed temperature by the heat of the front end portion 32$x$ of the second right guide 32. Thus, the portion 12$x$ of the raw material 1 is partially decreased in deformation resistance.

Furthermore, the portion 12$y$ of the raw material 1 corresponding to the portion of the second right guide 32 located behind the front end portion 32$x$ of the second right guide 32 at the right side portion 3R of the raw material 1 is partially cooled by circulating cooling fluid in the cooling fluid passage 86*a* of the second cooling means 86. This restrains deterioration of the deformation resistance of the portion 12$y$ of the raw material 1.

Figure 17:
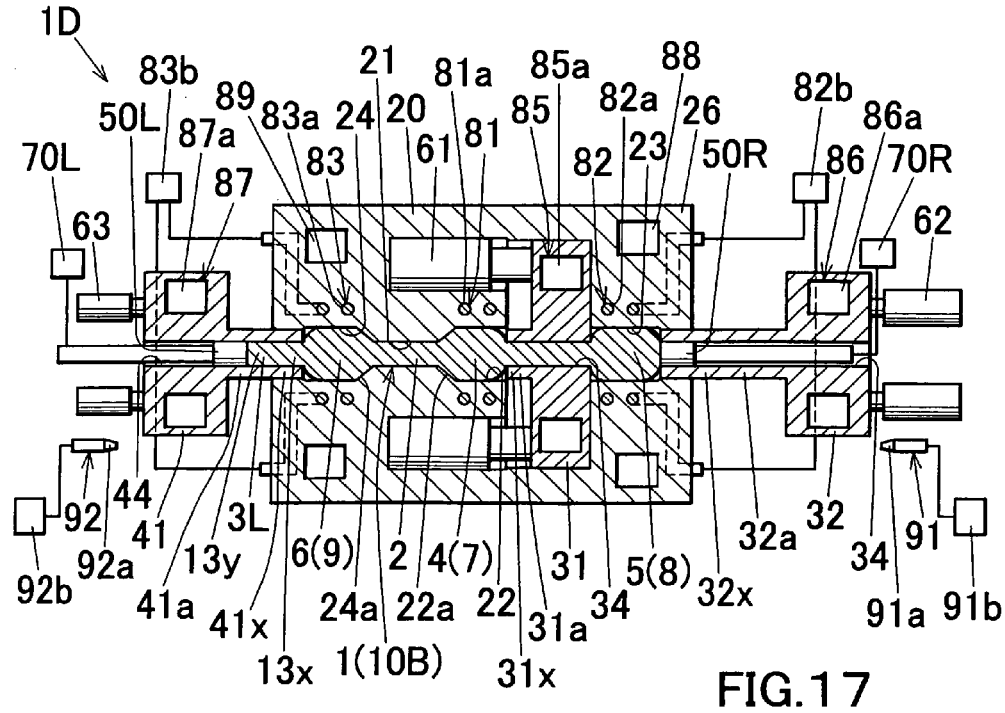
FIG. 17 is a vertical cross-sectional view of the principal part of the upsetting apparatus showing the state after expanding the prescribed portions of the raw material with the upsetting apparatus.

Next, while maintaining this state, in the same procedures as in the upsetting method shown as the second embodiment, as shown in FIG. 17, the second exposed portion 5 of the raw material 1 and the third exposed portion 6 thereof are simultaneously expanded in diameter.

The upsetting of the raw material 1 is completed at three portions through the above procedures.

Thereafter, the raw material 1 is removed from the insertion hole 21 of the fixed die 20 and the insertion holes 34, 34 and 44 of each of the guides 31, 32 and 41. Thus, a desired upsetting manufactured product 10B shown in FIG. 9 can be obtained.

Thus, the upsetting method of the fourth embodiment has the advantages of the upsetting method of second embodiment and further the advantages of the upsetting method of the third embodiment.

Although some embodiments of the present invention were explained above, the present invention is not limited to one of them, and can be changed variously.

For example, in the present invention, in cases where the second right guide 32 moved after the completion of moving the first right guide 31, after providing an initial clearance between the second right guide 32 and the first right guide 31 by moving only the second right guide 32 in a state in which the movement of a right punch 50R is stopped, the movement of the right punch 50R can be initiated. In this case, the diameter expansion working load required for the diameter expansion of the second exposed portion 5 can be reduced.

Moreover, in the aforementioned embodiment, although the number of the right guides is two, in the present invention, it can be three, four, or ever more.

Moreover, in the aforementioned embodiment, although the number of the left guide is one, in the present invention, it can be two, three, or more than three. In the case where the number of the left guides is plural, the same operation of the plurality of left guides as the right guide enables the diameter expansion of the left side portion of the raw material at plural portion.

In the aforementioned embodiments, for the explanatory purpose, the explanation was made by referring the axial one side portion of the raw material and the axial other side portion to as a "right side portion" and a "left side portion", respectively. In the present invention, however, it is not limited by the direction of the raw material.

Furthermore, in the present invention, the raw material can be expanded in diameter with the prescribed portion of the raw material heated to a prescribed temperature. Alternatively, the raw material can be expanded in diameter without heating the prescribed portion of the raw material.

That is, the upsetting method according to the present invention can be a heat upsetting method or a cold upsetting method.

EXAMPLES

Next, concrete examples of the present invention are shown below. However, the present invention is not limited to the following examples.

A round bar-shaped raw material 1 made of a continuously cast rolled material having a diameter of 12 mm manufactured by a Properzi method, and a round bar-shaped raw material 1 made of an extruded material having a diameter of 12 mm were prepared. The material of each of the raw materials 1 is a JIS (Japanese Industrial Standards) A6061 aluminum alloy. These raw materials 1 were subjected to upsetting using the upsetting apparatus 10C of the third embodiment. The molding pressure required at the upsetting was checked. The results are shown in Table 1.

TABLE 1

| | Type of raw material | Heating mode | Heating temperature | Cooling | Molding pressure |
|---|---|---|---|---|---|
| Example 1 | Rolled material | Partial heating | 500° C. | Yes | $4.4 \times 10^7$ Pa |
| Example 2 | Rolled material | Entire heating | 400° C. | No | $7.5 \times 10^8$ Pa |
| Example 3 | Extruded material | Partial heating | 500° C. | Yes | $7.1 \times 10^7$ Pa |
| Example 4 | Extruded material | Entire heating | 400° C. | No | $8.2 \times 10^8$ Pa |

Here, in the "heating mode" in Table 1, "Partial heating" denotes the case where the portion 11*x*, 12*x* and 13*x* of the raw material 1 corresponding to the front end portion 31*x*, 32*x* and 41*x* of each of the guides 31, 32 and 41 is partially induction-heated by the induction-heating means 81, 82 and 83. On the other hand, "entire heating" denotes the case where the entire raw material 1 was heated in a heating furnace, and then this raw material 1 in a heated state was quickly set in the upsetting apparatus 1C and then upsetting was performed.

In the "cooling" column, "Yes" denotes the case where the portion 11*y*, 12*y* and 13*y* of the raw material 1 corresponding to the portion of each guide 31, 32 and 41 located behind the front end portion 31*x*, 32*x* and 41*x* of each guide 31, 32 and 41 is cooled by each cooling means 85, 86 and 87. "No" denotes the case where no cooling was performed.

As shown in Table 1, in the case where the raw material 1 made of continuously cast rolled material was used (Examples 1 and 2), the molding pressure could be reduced as compared with the case where the raw material 1 made of extruded material was used (Examples 3 and 4).

Furthermore, in the case where a partial heating was performed (Examples 1 and 3), the molding pressure could be reduced as compared with the case where entire heating was performed (Examples 2 and 4).

It should be understood that the terms and expressions used herein are used for explanation and have no intention to be used to construe in a limited manner, do not eliminate any equivalents of features shown and mentioned herein, and allow various modifications falling within the claimed scope of the present invention.

INDUSTRIAL APPLICABILITY

The present invention can be applied an upsetting method and an upsetting apparatus for expanding two or more portions of a bar-shaped raw material.

What is claimed is:

1. An upsetting method, comprising the steps of:

preparing a plurality of guides each having an insertion hole penetrated in an axial direction for holding a bar-shaped raw material in a buckling preventing state;

inserting and holding the raw material secured to a fixed die in each insertion hole of the plurality of guides in order; then expanding a first exposed portion of the raw material exposed between a first guide located at the foremost side of the plurality of guides and the fixed die by moving the plurality of guides in a direction opposite to a moving direction of a punch in a mutually adhering manner while pressurizing the raw material in the axial direction with the punch; and after completion of movement of the first guide, expanding a second exposed portion of the raw material exposed between a second guide and the first guide by relatively moving the second guide located behind the first guide among the plurality of guides in a direction opposite to a moving direction of the punch.

2. The upsetting method as recited in claim 1, wherein

"P" denotes an average moving speed of the punch beginning at an initiation of motion of the punch, "G" denotes an average moving speed of the first guide beginning at an initiation of motion of the first guide, "$X_0$" denotes a buckling limit length at a cross-sectional area of the raw material before executing the upsetting, "$X_1$" denotes a buckling limit length at a cross-sectional area of a diameter expanded portion to be formed by diameter expansion of the first exposed portion of the raw material, "X" denotes an initial clearance between the first guide and the fixed die ($0 \leqq X \leqq X_0$), "$t_0$" denotes a time lag from the initiation of motion of the punch to the initiation of motion of the first guide ($0 \leqq t_0$), "$l_0$" denotes a length of the raw material before executing the upsetting required for the diameter expanded portion, and "T" denotes an upsetting time from the initiation of motion of the punch, and wherein "G" satisfies a relational expression of $$0 \leqq G \leqq P(X_1 - X)/(l_0 - X_1 - Pt_0)$$

when $t_0 < T$, in a case in which the first exposed portion of the raw material is expanded in diameter in a non-restricted state.

3. The upsetting method as recited in claim 1, wherein

"P" denotes an average moving speed of the punch beginning at an initiation of motion of the punch, "G" denotes an average moving speed of the first guide beginning at an initiation of motion of the first guide, "$X_0$" denotes a buckling limit length at a cross-sectional area of the raw material before executing the upsetting, "X" denotes an initial clearance between a front end potion of the first guide and a bottom portion of the molding dented portion ($0 \leqq X \leqq X_0$), "$L_0$" denotes a length of the raw material before the upsetting required for the diameter expanded portion to be formed by diameter expansion of the first exposed portion, "$X_p$" denotes a stop position of the tip end portion of the punch with respect to the bottom portion of the molding dented portion obtained from a designed volume of the diameter expanded portion, "$X_g$" denotes a stop position of the front end portion of the first guide with respect to the bottom portion of the molding dented portion defined by design, and "$t_0$" denotes a time lag from the initiation of motion of the punch to the initiation of motion of the first guide ($0 \leqq t_0$), and wherein "G" satisfies a relational expression of $G=P(X_g-X)/(L_0-X_p-Pt_0)$ in a case in which the first exposed portion of the raw material is expanded in diameter in a molding dented portion formed in the fixed die.

4. The upsetting method as recited in claim 1, wherein at least the first guide among the plurality of guides is capable of being divided into a plurality of pieces by a dividing face vertically crossing the insertion hole.

5. The upsetting method as recited in claim 1, wherein the raw material is a round bar-shaped rolled material.

6. The upsetting method as recited in claim 5, wherein the raw material is a cast rolled material.

7. The upsetting method as recited in claim 5, wherein the raw material is a continuously cast rolled material.

8. The upsetting method as recited in claim 5, wherein the first exposed portion of the raw material and the second exposed portion thereof are expanded in diameter with lubricant adhering to a peripheral surface of each insertion hole of the plurality of guides.

9. The upsetting method as recited in claim 1, wherein the first exposed portion of the raw material is expand in diameter with a portion of the raw material corresponding to the front end portion of the first guide partially heated.

10. The upsetting method as recited in claim 9, wherein the portion of the raw material corresponding to the front end portion of the first guide is partially induction-heated by an induction-heating means.

11. The upsetting method as recited in claim 9, wherein the portion of the raw material corresponding to the front end portion of the first guide is partially heated by partially induction-heating the front end portion of the first guide by an induction-heating means.

12. The upsetting method as recited in claim 9, wherein the portion of the raw material corresponding to the front end portion of the first guide is partially heated into a half-molten state.

13. The upsetting method as recited in claim 9, wherein the first exposed portion of the raw material is expand in diameter in a state in which a portion of the raw material corresponding to a portion of the first guide located behind the front end portion of the first guide is partially cooled.

14. The upsetting method as recited in claim 1, wherein the second exposed portion of the raw material is expand in diameter with a portion of the raw material corresponding to a front end portion of the second guide partially heated.

15. The upsetting method as recited in claim 14, wherein the portion of the raw material corresponding to the front end portion of the second guide is partially induction-heated by an induction-heating means.

16. The upsetting method as recited in claim 14, wherein the portion of the raw material corresponding to the front end portion of the second guide is partially heated by partially induction-heating the front end portion of the second guide by an induction-heating means.

17. The upsetting method as recited in claim 14, wherein the portion of the raw material corresponding to the front end portion of the second guide is partially heated into a half-molten state.

18. The upsetting method as recited in claim 14, wherein the second exposed portion of the raw material is expand in diameter in a state in which a portion of the raw material corresponding to a portion of the second guide located behind the front end portion of the second guide is partially cooled.

19. An upsetting manufactured product obtained by the upsetting method as recited in claim 1.

20. The upsetting method as recited in claim 5, wherein the first exposed portion of the raw material and the second exposed portion thereof are expanded in diameter with lubricant adhering to a surface of the raw material.

* * * * *